US008864348B2

(12) United States Patent
Chen

(10) Patent No.: US 8,864,348 B2
(45) Date of Patent: Oct. 21, 2014

(54) LIGHT EMITTING DIODE BULB WITH A CUP-SHAPED HEAT DISSIPATING STRUCTURE

(76) Inventor: I-Ming Chen, New Taipei (TW)

( * ) Notice: Subject to any disclaimer, the term of this patent is extended or adjusted under 35 U.S.C. 154(b) by 175 days.

(21) Appl. No.: 13/417,731

(22) Filed: Mar. 12, 2012

(65) Prior Publication Data

US 2013/0120973 A1 May 16, 2013

(30) Foreign Application Priority Data

Nov. 11, 2011 (TW) ..... 100221307 U

(51) Int. Cl.

| | |
|---|---|
| ***F21V 29/00*** | (2006.01) |
| ***F21V 29/02*** | (2006.01) |
| ***F21V 21/00*** | (2006.01) |
| ***F21V 15/01*** | (2006.01) |
| ***F21V 21/04*** | (2006.01) |
| *F21V 23/00* | (2006.01) |
| *F21Y 101/02* | (2006.01) |

(52) U.S. Cl.

CPC ..... *F21V 29/2287* (2013.01); *F21V 15/011* (2013.01); *F21V 23/009* (2013.01); *F21V 21/044* (2013.01); *F21Y 2101/02* (2013.01)

USPC ..... 362/373; 362/294; 362/362; 362/249.02; 313/46

(58) Field of Classification Search

USPC ..... 362/294, 235, 277, 363, 373

See application file for complete search history.

(56) References Cited

U.S. PATENT DOCUMENTS

| | | | | |
|---|---|---|---|---|
| 2008/0212333 | A1* | 9/2008 | Chen | 362/373 |
| 2010/0020537 | A1* | 1/2010 | He et al. | 362/234 |
| 2010/0026157 | A1* | 2/2010 | Tanaka et al. | 313/45 |
| 2010/0225220 | A1* | 9/2010 | Tanaka et al. | 313/46 |
| 2011/0128730 | A1* | 6/2011 | Chiu | 362/235 |
| 2012/0033419 | A1* | 2/2012 | Kim et al. | 362/235 |
| 2012/0314426 | A1* | 12/2012 | Chen | 362/363 |

FOREIGN PATENT DOCUMENTS

EP 1950491 A1 * 7/2008

* cited by examiner

*Primary Examiner* — Sikha Roy

(74) *Attorney, Agent, or Firm* — Muncy, Geissler, Olds & Lowe, P.C.

(57) ABSTRACT

An LED bulb comprises a lamp cup, a substrate, a power connecting part, and a cover plate. The lamp cup is a two-piece structure; a power driver is further disposed in the power connecting part. The substrate is disposed in the lamp cup, while the power connecting part connects with the lamp cup. When the light sources and the power structure generate heat, the generated heat can be transferred outwards and dissipated through the lamp cup or the power connecting part. Because the heat generated by both of the heat sources in the lamp cup, respectively, the co-heating effect induced by the light sources and the power driver can be avoided. The overall structure is manufactured by materials having superior thermal conductivity. Thereby, with the structure, heat dissipating process can be accelerated. The lifetime of the light sources can be improved substantially.

21 Claims, 24 Drawing Sheets

LIGHT EMITTING DIODE BULB WITH A CUP-SHAPED HEAT DISSIPATING STRUCTURE

FIELD OF THE INVENTION

The present invention relates generally to a light emitting light (LED) bulb, and particularly to a cup-shaped heat dissipating structure applicable to an LED bulb for accelerating the heat dissipating process.

BACKGROUND OF THE INVENTION

Modern tungsten incandescent lamps are developed at the turn of the twentieth century. The light emitting body therein is a tungsten filament. This material features a high melting point, which maintains its solid state in high temperatures. Thereby, the bulbs can have longer lifetime; the filaments will not burn down in a short time. Practically, a temperature of the filament of a lighted incandescent bulb is as high as 3000° C.; it is the light radiation produced by the incandescent filament to make the bulb emit bright rays of light. Thereafter, nights no longer hold back people's lives. With the light brought by incandescent bulbs, night activities, no matter in work or living, can go on with great convenience and enabling many possibilities. The invention of incandescent bulbs significantly changes people's lifestyle; the time slots for activities are extended in many aspects, and thus facilitating developments of various kinds.

With the progress of lighting technologies, various lighting bulbs are developed. Among all electrical lighting bulbs, incandescent bulbs are the least efficient. They have a very bad energy conversion rate of only 12~18%; the rest energy is dissipated and wasted in the thermal form. Thanks to the advancement and maturity of the LED, peripheral integrate-circuit control device, and heat dissipating technologies, the applications of LEDs are diversified from low-power power indicators and light sources for mobile phones to LED backlight modules and general lighting products. Thereby, LEDs are replacing traditional light sources gradually. In comparison with the short lifetime and heat of incandescent bulbs, LEDs have the advantages of low power consumption, no mercury, no halides, and low carbon-dioxide emission. Considering the environmental protection issues, many countries have set a time limit to prohibit incandescent bulbs for saving energy, reducing carbon, and reducing usage of mercury and halides, and turn to promote LEDs completely.

Besides, because LEDs are point light sources, they have more design flexibility. A bulb can be made with distributed light sources and hence not offending to the eye. Alternatively, the light of a bulb can be made to concentrate at a point or over a specific region. The produced colors can be more vivid and bright. Presently, the light emitting efficiency of a white-light LED has reached 70 lm/W, which exceeds 15 lm/W of an incandescent bulb. Nonetheless, currently, only 35% of the input power to an LED is converted to light with the rest 65% s converted to heat, which is the main cause deteriorating the light emitting efficiency of the LED. In addition, if the heat dissipating mechanism of the overall device is not good, the generated heat by the LED will accumulate therein and cannot be dissipated immediately, which will shorten the lifetime of the LED. Generally, the lifetime of an LED bulb is above 100,000 hours. However, if the operating temperature is greater than 85° C., its lifetime will be greatly reduced.

Accordingly, while bulbs, including LED bulbs, are being used, increase in heat is an inevitable result. Heat dissipation is the scheme for solving this problem. The focus of related technologies will be put on how to enhance the heat dissipating efficiency of various parts for accelerating heat dissipation and thus improving the lifetime. In an LED bulb, there are two heat sources, including the light sources and the power driver. The heat dissipation for both should be performed. If the heat dissipating mechanism is not good, the heat generated by the light sources will be transferred to the central part through heat conduction. Then the co-heating effect between the heat generated by the light sources and the heat generated by the power driver will occur. Owing to the effect, the internal temperature will be excessively high, damaging the electronic components in the power driver. In addition to affecting the lifetime of the power driver severely, the light emitting efficiency will be reduced because the co-heating effect keeps the temperature of the light sources high. This is usually caused by damages inside the power driver but not by the problem in the light emitting efficiency of the light sources. Moreover, in addition to reducing the lifetime of the bulb, the co-heating-effect-induced temperature rise also raises the room temperature and hence making users uncomfortable. Thereby, heat dissipating mechanism is a very important subject is this field.

While various bulbs are being used, if the heat dissipating mechanism is not designed in the lamp stand, the heat generated by the light sources and the power driver is hard to be removed and producing bad influences. Accordingly, the present invention provides an LED bulb, which is mainly applied to the heat dissipation of the bulb. The lamp cup of the LED bulb according to the present invention is a hollow two-piece structure. It is divided into a lamp-cup part and a light receiving part. After assembling with the power connecting part, an integral and smooth appearance is formed. The heat generated by the substrate placed in the lamp-cup part and by the power driver in the power connecting part of the lamp cup is dissipated through the lamp cup or outwards directly. Thereby, the co-heating effect induced by the substrate and the power driver can be solved effectively. For better heat dissipating effect, the bulb can be manufactured using materials with superior heat dissipating capability; for even better effect, the corresponding heat dissipating members can be used, too. Besides, it should be assembled by wedging for easier and more convenient fabrication. Accordingly, in addition to improving the lifetime of the bulb, the structure is safer more users; various problems caused by high temperature can be avoided.

SUMMARY

An objective of the present invention is to provide an LED bulb for providing better heat dissipating mechanism for light sources. When the light sources generate heat, the heat is transferred to the lamp cup structure by convection. Then the structure can transfer the heat to the surrounding environment rapidly. Thereby, the overall heat dissipating performance is improved and hence enhancing the lifetime of the bulb.

Another objective of the present invention is to provide an LED bulb for providing a heat dissipating method for the power driver. The heat generated by the power driver is transferred to the lamp cup or to the surrounding environment via the power connecting part for heat dissipation. The structure provides a better heat dissipating method for improving the efficiency of the overall heat dissipating process.

Another objective of the present invention is to provide an LED bulb for providing an easier and more convenient assembling method for manufacturers. By using wedge structures for assembling the lamp cup, manufacturers can save extra steps during fabrication. It is not necessary to adopt relatively complicated soldering or riveting method. Thereby, manufacturing cost and time can be saved.

Another objective of the present invention is to provide an LED bulb, which provides a heat dissipating member stacked between a lamp-cup part and a light receiving part. The heat dissipating member is attached tightly to the light receiving part for enhancing the heat dissipating effect of the light receiving part. Thereby, the lifetime of the bulb can be improved.

Another objective of the present invention is to provide an LED bulb, which has an annular concave part in a first accommodating space of the lamp-cup part. The annular concave part has at least a heat dissipating hole. By means of heat convection, the heat dissipating effect of a substrate can be improved.

Another objective of the present invention is to provide an LED bulb for providing a heat dissipating structure with integral appearance. The components according to the present invention are purposely designed. After the lamp cup and the power connecting part are assembled, together with the corresponding heat dissipating members, the bulb exhibits an integral and smooth appearance and features outstanding practicability and aesthetics, which will facilitate purchasing decisions of consumers.

Still another objective of the present invention is to provide an LED bulb for bringing more convenience for users. The structure of the lamp-cup part according to the present invention is purposely designed. The heat dissipating holes disposed thereon has heat dissipating function as well as acting as clipping holes. Thanks to the special structure and the clipping holes, users can dispose the bulb according to the present invention to downlight frames, rail frames, clipping frames, or hollow circular frames; the bulb is very flexible for installation.

For achieving the objectives described above, the present invention provides an LED bulb, which comprises a lamp cup, a substrate, and a power connecting part. The lamp cup has a hollow structure, and can be further divided into a light receiving part and a lamp-cup part. The light receiving part on the top while the lamp-cup part is at the bottom. Besides, there is an accommodating space in the two parts, respectively. LED chips, which are the light sources of the LED bulb according to the present invention, are installed on substrate. The substrate is disposed in the accommodating space of the light receiving part. On the other hand, the power connecting part is disposed in the accommodating space of the lamp-cup part. The power connecting part and the lamp-cup part can connect to each other and form an identity with integral appearance. In addition to separating directly the light sources and the power connecting part by the lamp-cup part, when the light sources and the power driver inside the power connecting part generate heat, the generated heat can be transferred outwards and dissipated through the lamp-cup part or the power connecting part. The overall structure is manufactured by materials having superior thermal conductivity. Thereby, by means of the structure, heat in various parts can be dissipated effectively and avoiding the co-heating effect induced by heat generated by both the light sources and the power driver. Consequently, the light emitting efficiency as well as the lifetime of the light sources can be improved substantially. Furthermore, the overall lamp cup structure is assembled by wedging, which brings convenience and hence saving cost and time for assembling.

In addition, the present invention further has an annular convex part and a heat dissipating member. By using different methods of heat dissipating mechanism, the heat dissipating effect of the LED bulb is enhanced and thus improving the lifetime of the LED bulb.

Moreover, the lamp cup and the power connecting part of the LED bulb further comprise a plurality of heat dissipating holes disposed on the surfaces of the lamp cup and the power connecting part. The plurality of heat dissipating holes are disposed annularly for improving the heat dissipating effect of the lamp cup. Besides, the LED bulb can adapt to lamp stands of various sizes so that the heat dissipating holes will not be blocked completely after assembling. Consequently, the heat dissipating mechanism can continue taking effect. If the light emitting power of light sources is increased, for even better heat dissipating effect, the corresponding heat dissipating members can be further adopted.

The LED bulb further comprises a lampshade disposed on the light receiving part of the lamp cup. Thereby, the glare, which may discomfort users, produced by LED light sources of the LED bulb can be avoided.

The heat dissipating holes on the lamp-cup part of the LED bulb further have the function of clipping holes. Together with the structure of the lamp-cup part, the clipping holes can be used for disposing various frames. Users can choose the required frame according to their decoration, which brings convenience and flexibility in usage.

DETAILED DESCRIPTION

Figure 1:
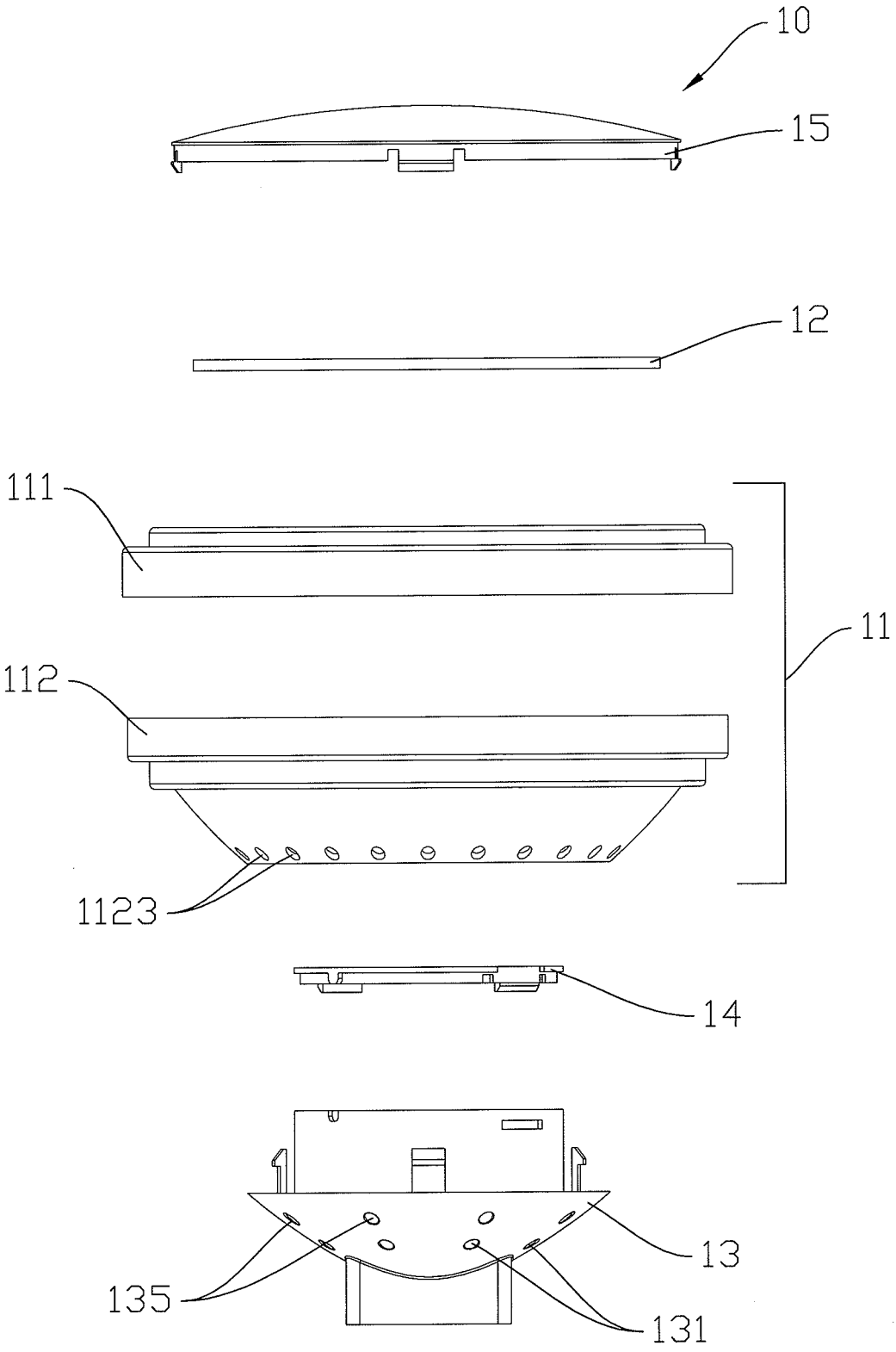
FIG. 1 shows an exploded view of the LED bulb according to the first embodiment of the present invention.
Figure 1A:
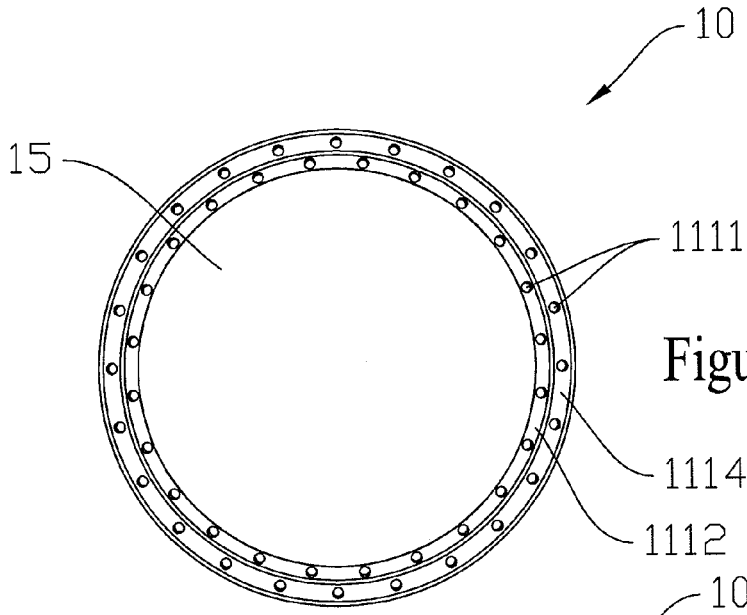
FIG. 1A shows a top view of the LED bulb according to the first embodiment of the present invention.
Figure 1B:
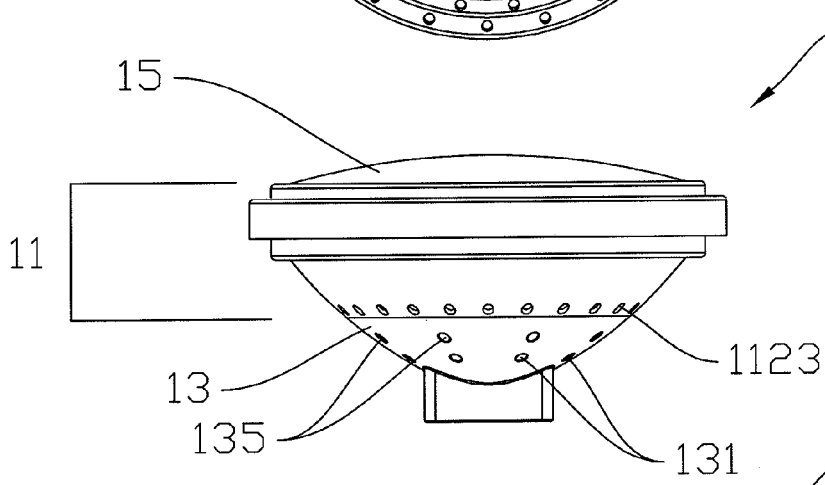
FIG. 1B shows a side view of the LED bulb according to the first embodiment of the present invention.
Figure 1C:
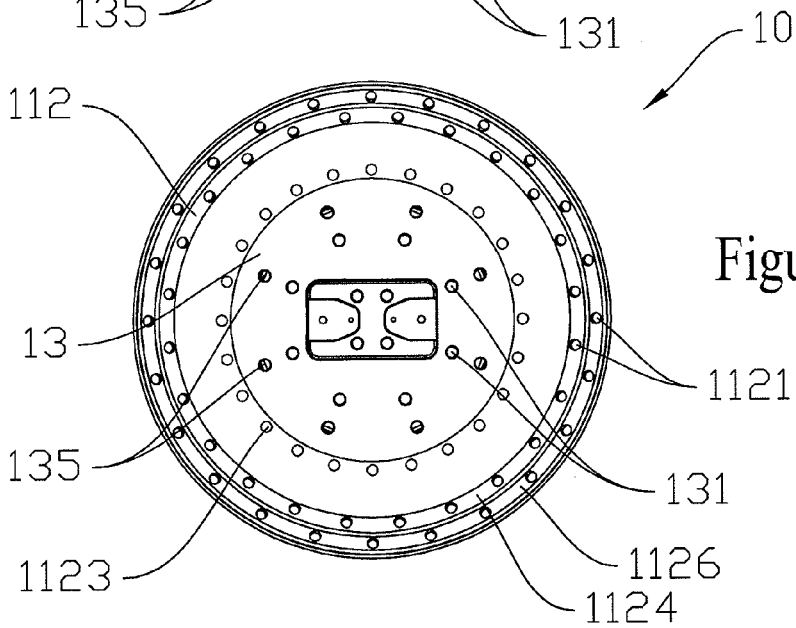
FIG. 1C shows a bottom view of the LED bulb according to the first embodiment of the present invention.
Figure 1D:
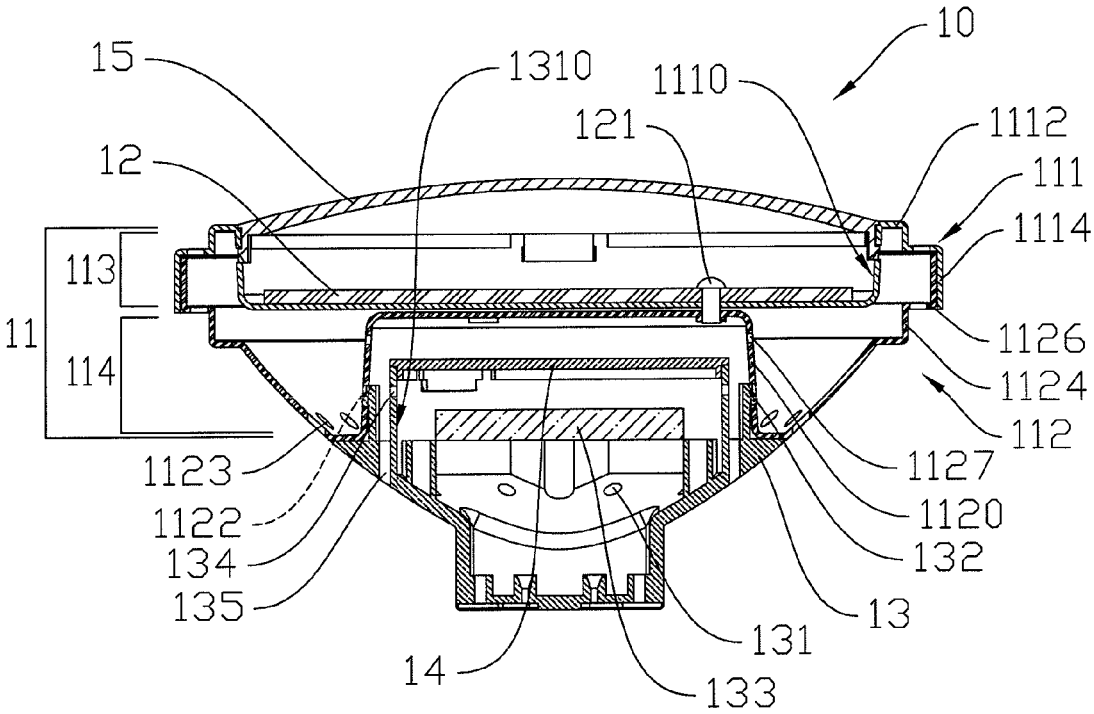
FIG. 1D shows a cross-sectional view of the LED bulb according to the first embodiment of the present invention.

In order to make the structure and characteristics as well as the effectiveness of the present invention to be further understood and recognized, the detailed description of the present invention is provided as follows along with embodiments and accompanying figures.

The present invention relates to an LED bulb, which provides a better heat dissipating structure for solving the problems induced by the lamp-cup structure without heat dissipating mechanism according to the prior art. By means of the structure according to the present invention, the heat generated by the light sources and power driver can be dissipated through the lamp cup and the power connecting part. The multiple circles of heat dissipating holes on the lamp cup can accelerate the overall heat dissipating process. Thereby, the light emitting efficiency and the lifetime of the bulb can be improved.

FIGS. 1, 1A, 1B, 1C, and 1D show an exploded, top, side, bottom, and cross-sectional view of the LED bulb according to a first embodiment of the present invention. The LED bulb 10 according to the present invention comprises a lamp cup 11, a substrate 12, and a power connecting part 13. The lamp cup 11, which is a two-piece structure, includes a light receiving part and a lamp-cup part 112. The light receiving part 111 has a first hollow cylinder 1110, which includes a first accommodating space 113 atop. The lamp-cup part 112 has a second hollow cylinder 1120. The bottom of the second hollow cylinder 1120 is recessed to form a second accommodating space 114. Besides, the second hollow cylinder 1120 is stacked below the first hollow cylinder 1110. The substrate 12 is disposed in the first accommodating space 113 and fastened inside the light receiving part 111 by a copper screw 121. The substrate 12 carries LED chips, which are the light sources of the bulb. The power connecting part 13 is disposed in the second accommodating space 114 and includes a third hollow cylinder 1310. A power driver 133 is disposed in the third hollow cylinder 1310. Thermally conductive paste can be filled therein. In addition, the lamp cup 11 separates the substrate 12 from the power connecting part 13.

Figure 1E:
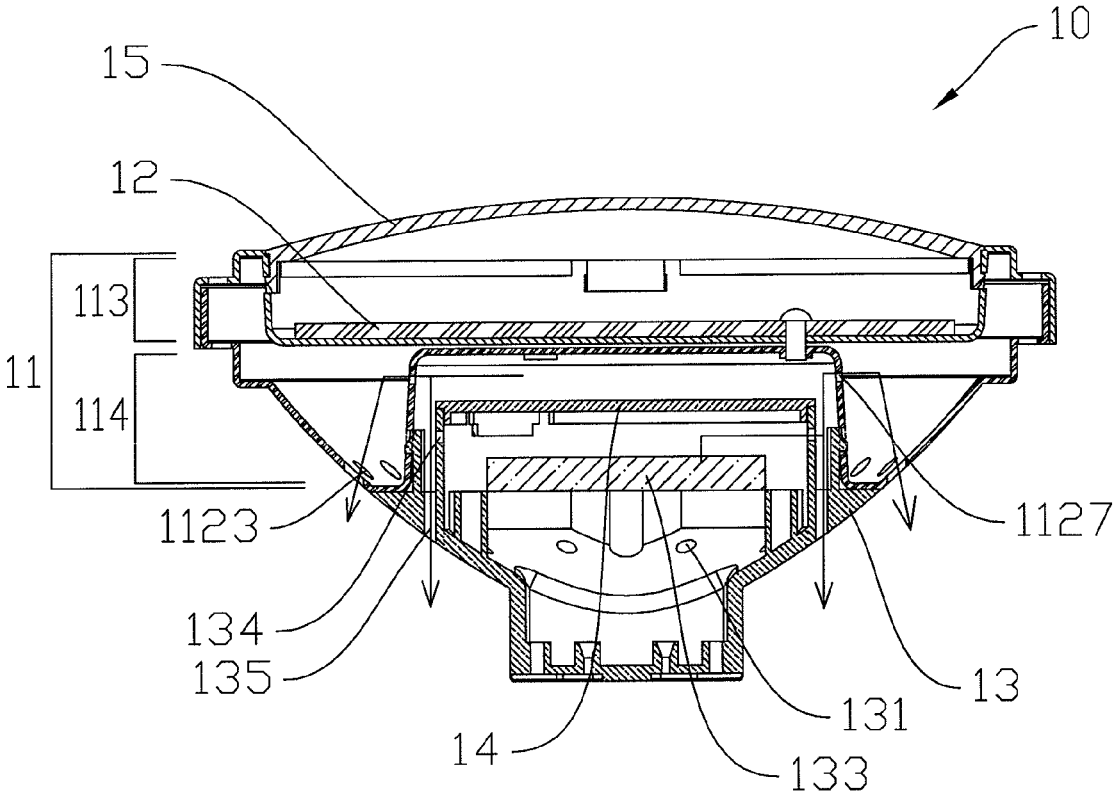
FIG. 1E shows a schematic diagram of heat dissipation inside the LED bulb according to the first embodiment of the present invention.

FIG. 1E shows a schematic diagram of heat dissipation inside the LED bulb according to the first embodiment of the present invention. In the heat source part, the junctions of the substrate 12, light receiving part 111, and the lamp cup 112 are bound with thermally conductive paste or glue. Thereby, the heat dissipating path of the heat generated by the substrate 12 is transferred to the lamp-cup part 112 in thermal conduction via the thermally conductive paste and the copper screw 121. Then the heat is conducted downwards and dissipated outward through fourth heat dissipating holes 1127 and third heat dissipating holes 1123 or through seventh heat dissipating holes 135 directly. Alternatively, the heat can be dissipated through the power connecting part 13 or fifth heat dissipating holes 131. The heat dissipating path of the power driver 133 includes, firstly, sixth heat dissipating holes 134. Then the path is divided into two paths. One of the paths is to pass through the fourth heat dissipating holes 1127 and the third heat dissipating holes 1123 and lead to outside. The other path is to dissipate through the seventh heat dissipating holes 135. Thereby, the substrate 12 and the power driver 133 can dissipate heat separately, and hence preventing the co-heating effect induced by the heat generated by the two parts. Consequently, the light emitting efficiency and the lifetime of the light sources will be affected and deteriorated.

In addition, the power connecting part 13 further comprises a plurality of stop members 132 disposed on the side of the third hollow cylinder 1310. The second accommodating space 114 of the lamp-cup part 112 has a plurality of wedging holes 1122 disposed on its sidewall. The plurality of stop members 132 are wedged to the plurality of wedging holes 1122 of the lamp-cup part 112 and forming an integral body having smooth appearance. The method for assembling various components is not limited to wedging. Other methods that comply with spirits of the present invention and are simple, for example, assembling by scarfing, are within the scope of the present invention.

Moreover, a cover plate 14 is further disposed on the top of the power connecting part 13. The power driver 133 supplies power to the light sources. By using the structure, the thermal conduction of the heat generated by the power connecting part 13 to the lamp cup 11, or vice versa, can be blocked. Thereby, the lifetime of the power driver 133 in the power connecting part 13 or the light emitting efficiency of the LED chips in the lamp cup 11 can be enhanced. The lamp cup 11 can be isolated from the power connecting part 13 by means of the cover plate 14. A space can be further left for avoiding mutual influences of the heat generated by the power connecting part 13 and the lamp cup 11 on their performances.

Besides, the LED bulb 10 further comprises a lampshade 15 disposed on the first accommodating space 113. The material of the lampshade 15 is transparent or light diffusive. Because the light sources are LED chips, which are point light sources, looking directly on them is glaring and uncomfortable to users. Thereby, the lampshade 15 is made of acrylic or PC materials for diffusing the light of LEDs.

The light receiving part 111 further comprises a first annular body 1112 and a second annular body 1114. The first and second annular bodies 1112, 1114 are disposed on top of the first hollow cylinder 1110 and extend outwards in sequence. The diameter of the first annular body 1112 is smaller than that of the second annular body 1114. The lamp-cup part 112 further comprises a first annular groove 1124 and a second annular groove 1126. The first and second annular grooves 1124, 1126 are disposed on the top of the second hollow cylinder 1120 and extend from bottom up in sequence. The diameter of the first annular groove 1124 is smaller that that of the second annular groove 1126. The assembling of the light receiving part 111 with the lamp-cup part 112 according to the LED bulb of the present invention is accomplished by wedging the second annular body 1114 in the second annular groove 1126.

Figure 1F:
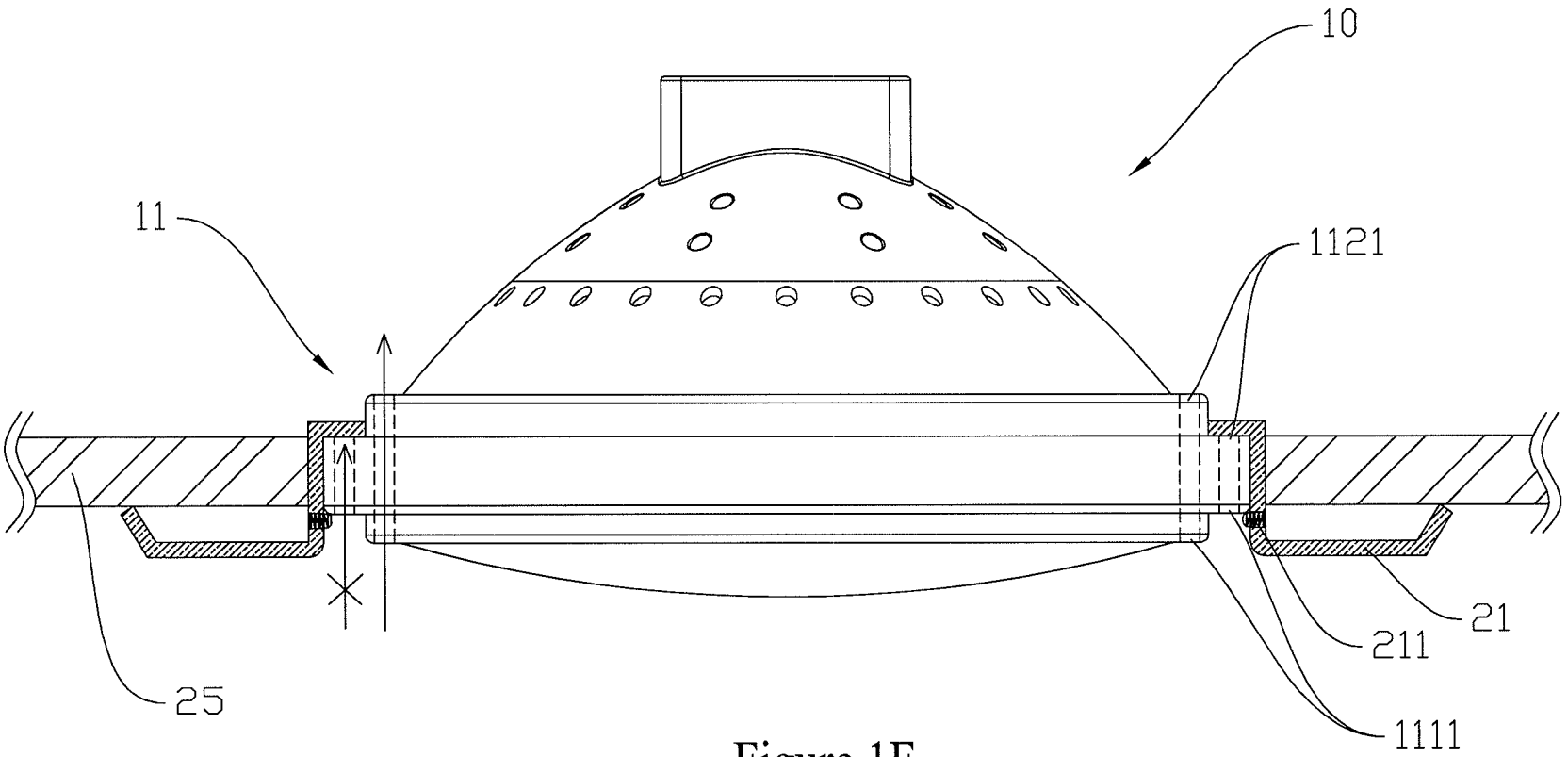
FIG. 1F shows a schematic diagram of heat-dissipating convective channels of the LED bulb according to the first embodiment of the present invention.
Figure 2:
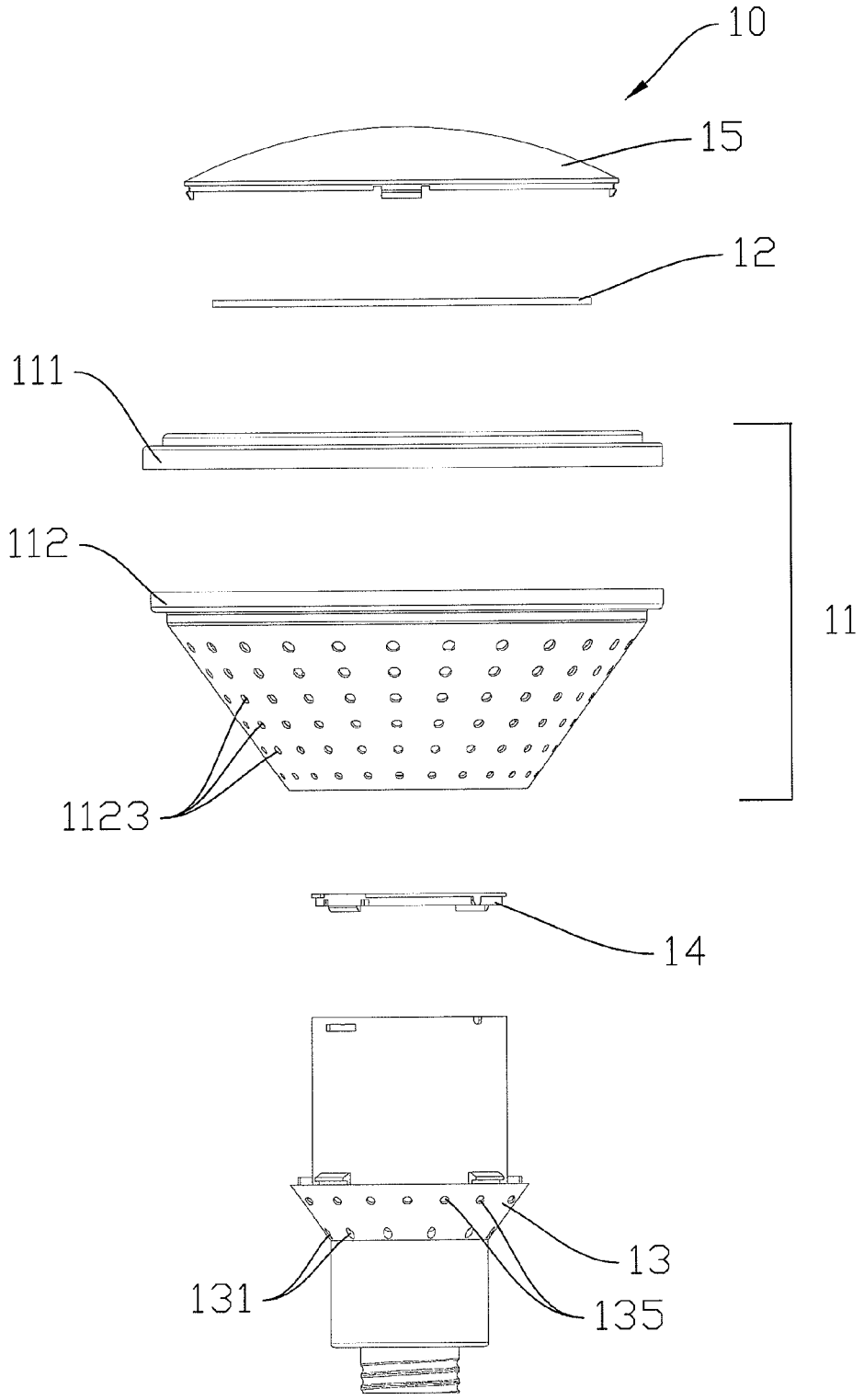
FIG. 2 shows an exploded view of the LED bulb according to the second embodiment of the present invention.
Figure 2A:
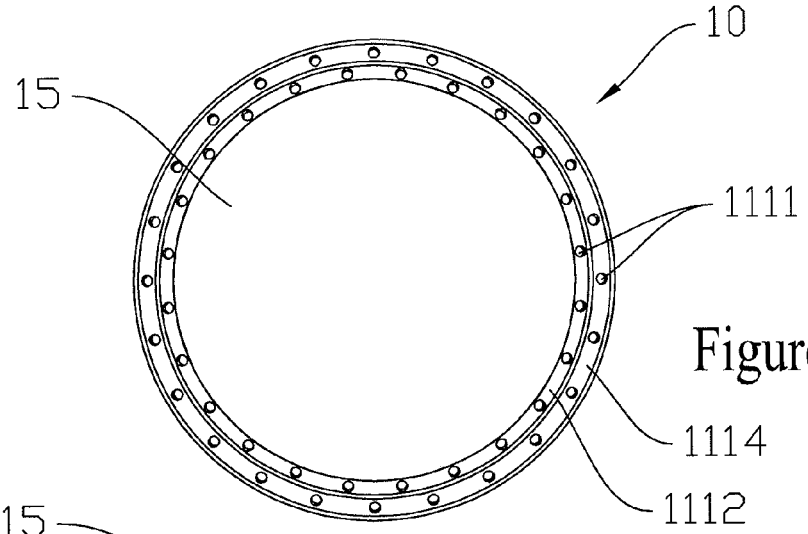
FIG. 2A shows a top view of the LED bulb according to the second embodiment of the present invention.
Figure 2B:
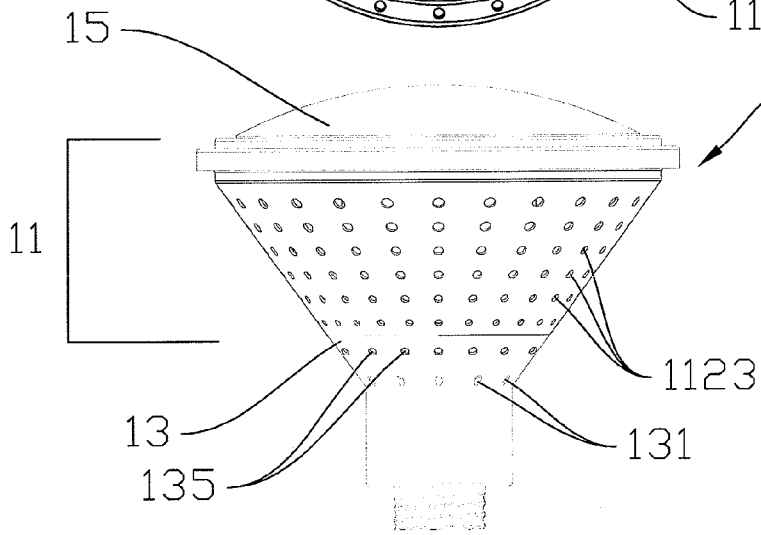
FIG. 2B shows a side view of the LED bulb according to the second embodiment of the present invention.
Figure 2C:
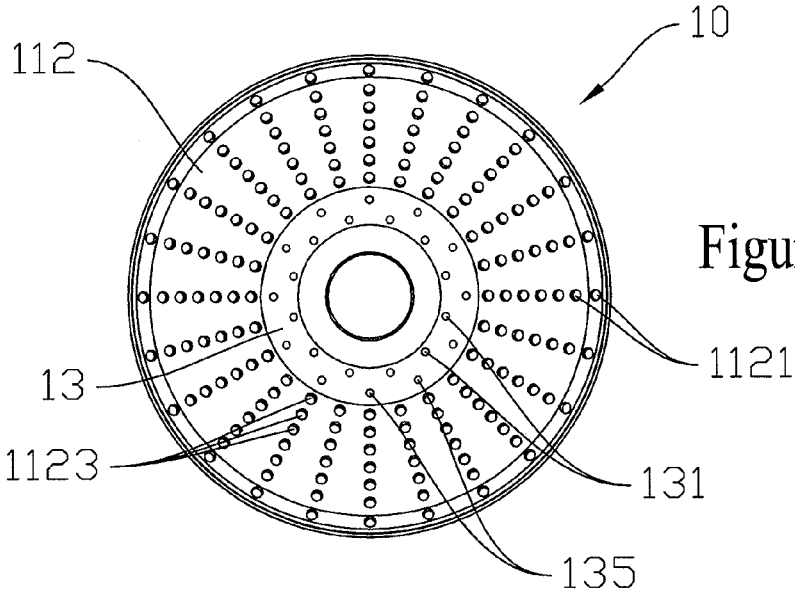
FIG. 2C shows a bottom view of the LED bulb according to the second embodiment of the present invention.
Figure 2D:
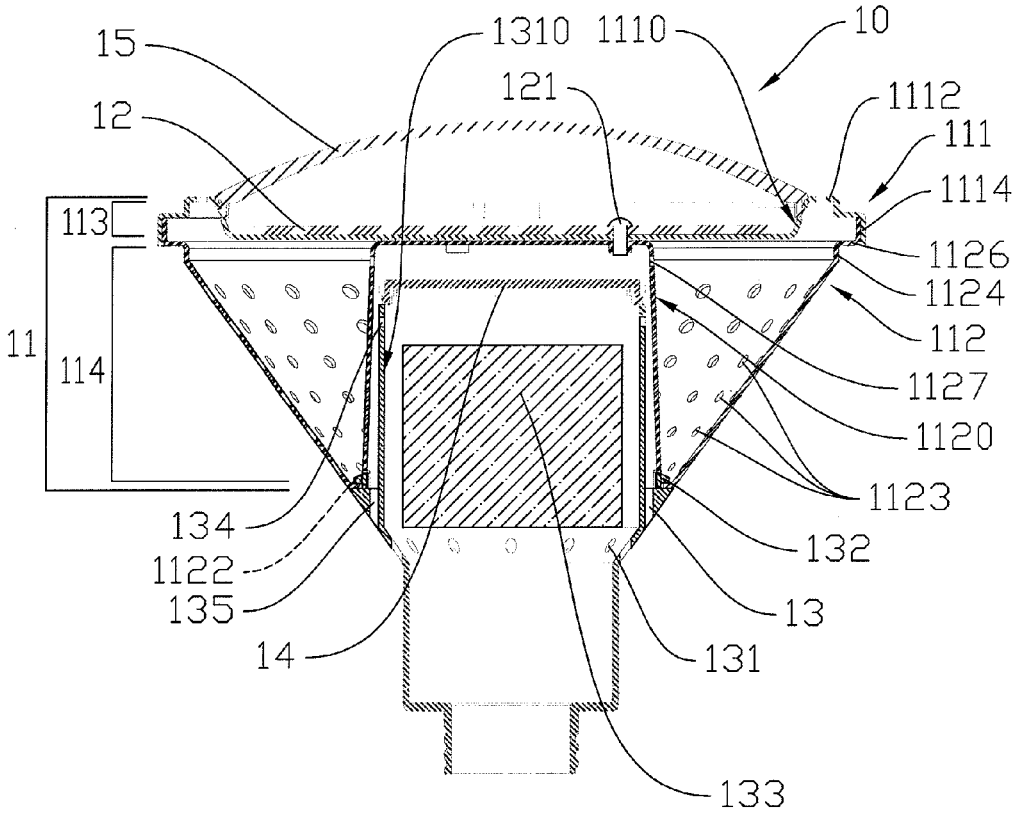
FIG. 2D shows a cross-sectional view of the LED bulb according to the second embodiment of the present invention.
Figure 2E:
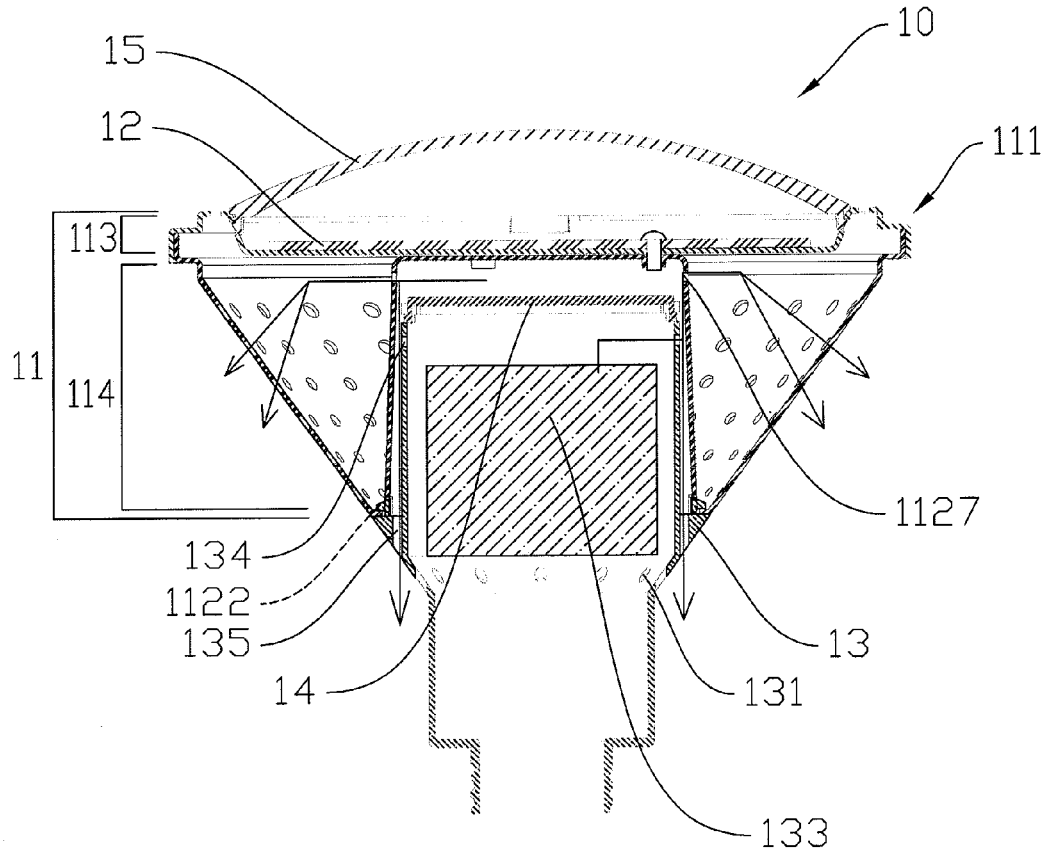
FIG. 2E shows a schematic diagram of heat dissipation inside the LED bulb according to the second embodiment of the present invention.

The light receiving part 111, the lamp-cup part 112, and the power connecting part 13 further comprises, respectively, a plurality of first heat dissipating holes 1111, second heat dissipating holes 1121, third heat dissipating holes 1123, and fourth heat dissipating holes 131. The plurality of first heat dissipating holes 1111 are disposed on the first and second annular bodies 1112, 1114; the plurality of second heat dissipating holes 1121 are disposed on the first and second annular grooves 1124, 1126; the plurality of third heat dissipating holes 1123 are disposed on the side of the second hollow cylinder 1120; and the plurality of fourth heat dissipating holes 131 are disposed on the outer side of the power connecting part 13. The number of circles and sizes of the plurality of holes can be adjusted according to requirements. In addition to improving heat dissipating effect, the plurality of holes, they have the effect of corresponding to various frames. FIG. 1F shows a schematic diagram of heat-dissipating convective channels of the LED bulb according to the first embodiment of the present invention. The plurality of first heat dissipating holes 1111 of the lamp cup 11 are disposed matching the plurality of second heat dissipating holes 1121. Thereby, a plurality of circles of facing heat-dissipating convective channels are formed in the lamp cup 11. While installing the lamp to various frames, for example, a downlight frame 21, even it is covered by the frame, freely flowing heat-dissipating convective channels are still maintained. The convective effect will not be completely lost owing to the coverage of the frame.

FIGS. 2, 2A, 2B, 2C, 2D, and 2E show exploded, top, side, bottom, cross-sectional views of the LED bulb and a schematic diagram of heat dissipation inside the LED bulb according to a second embodiment of the present invention. As shown in the figures, the difference between the present embodiment and the first embodiment is that, according to the present embodiment, the power connecting part 13 is longer, and the size of the lamp-cup part 112 of the lamp cup 11 is also adjusted corresponding to the size of the power connecting part 13. Thereby, the various parts of the present invention can be adjusted according to the practical requirements, and is not limited to the previous embodiment.

Figure 3:
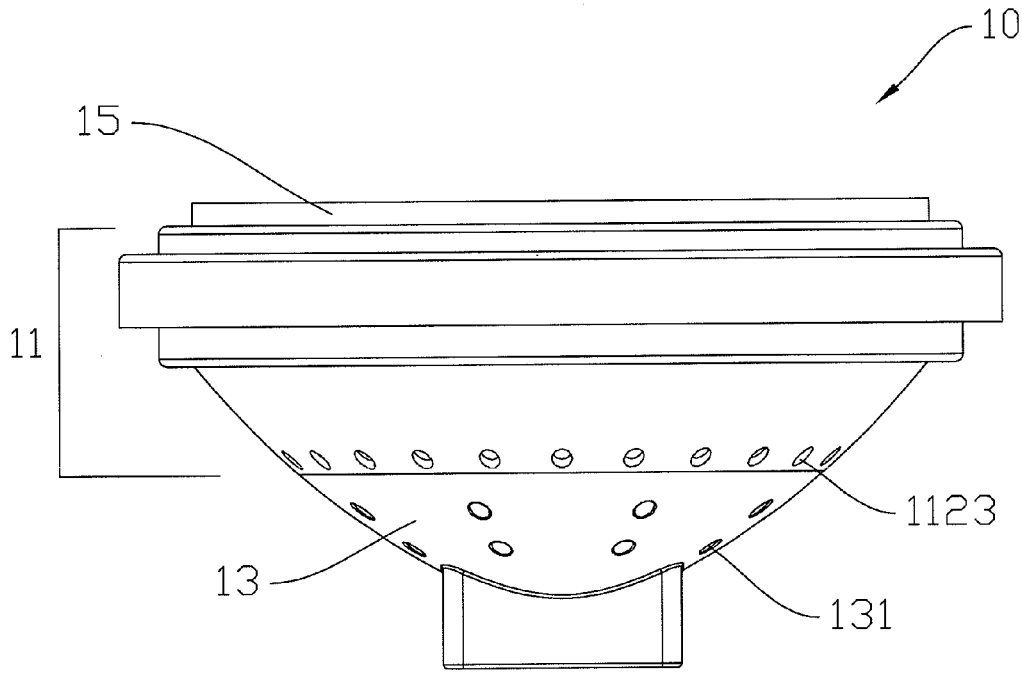
FIG. 3 shows a schematic diagram of applying a flat lampshade to the LED bulb according to the present invention.
Figure 4A:
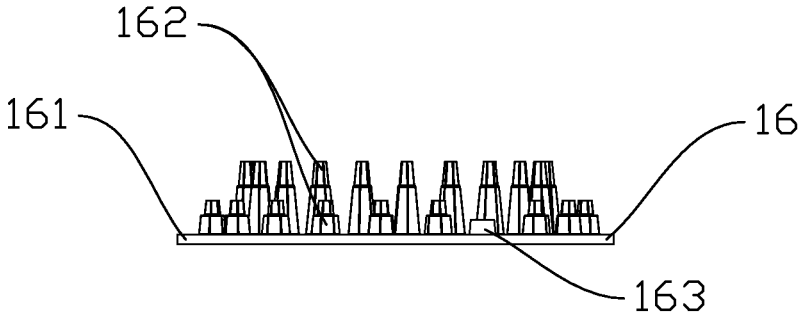
FIG. 4A shows a side view of the heat dissipating member of the LED bulb according to the first embodiment of the present invention.
Figure 4B:
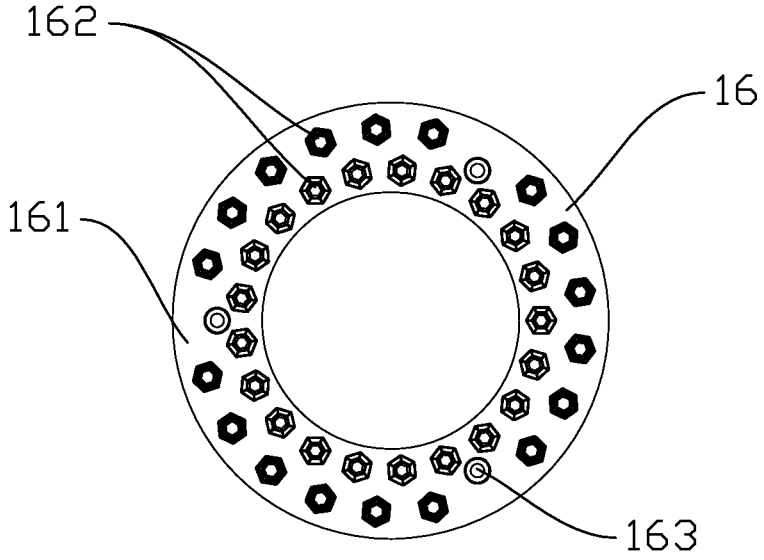
FIG. 4B shows a top view of the heat dissipating member of the LED bulb according to the first embodiment of the present invention.
Figure 4C:
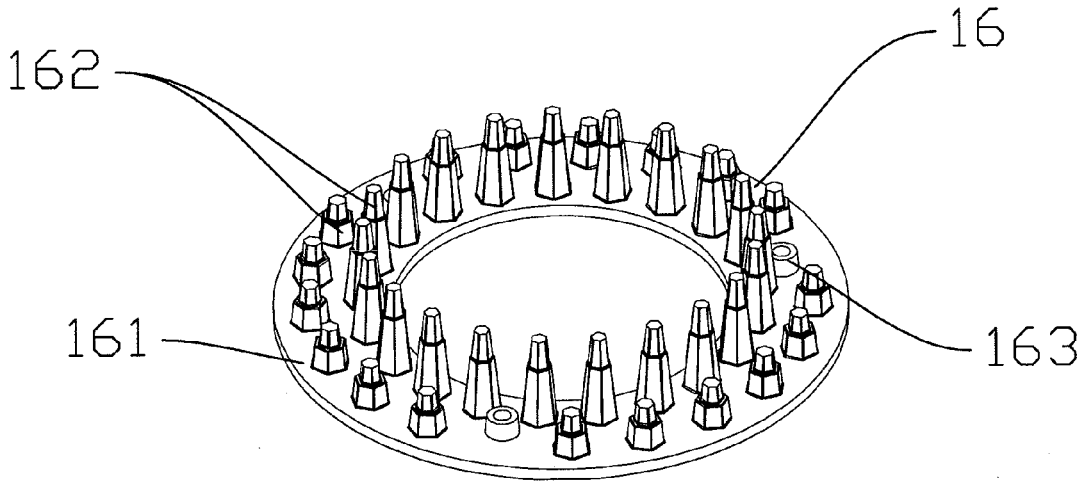
FIG. 4C shows a three-dimensional view of the heat dissipating member of the LED bulb according to the first embodiment of the present invention.
Figure 4D:
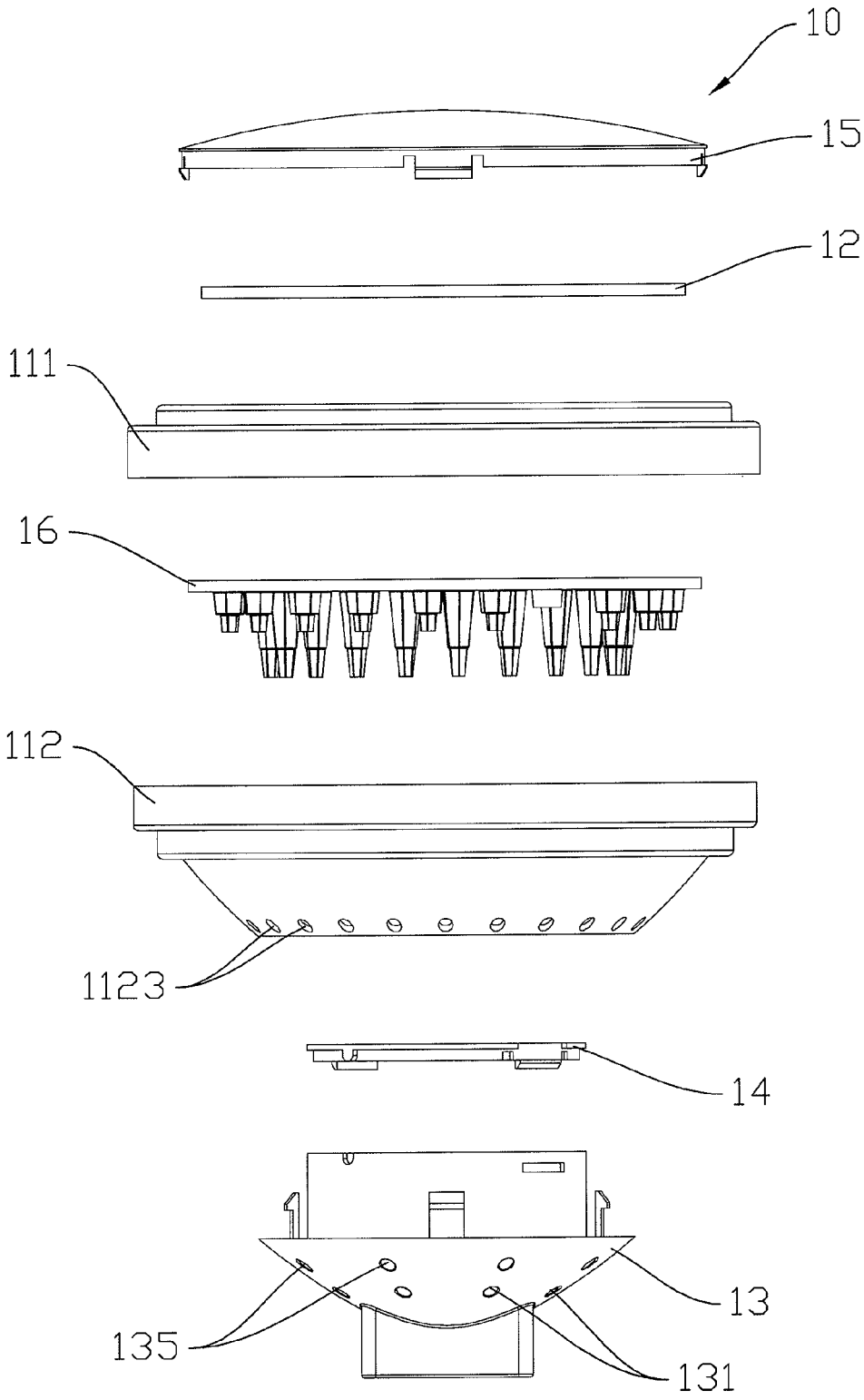
FIG. 4D shows an exploded view for assembling the heat dissipating member of the LED bulb according to the first embodiment of the present invention.
Figure 4E:
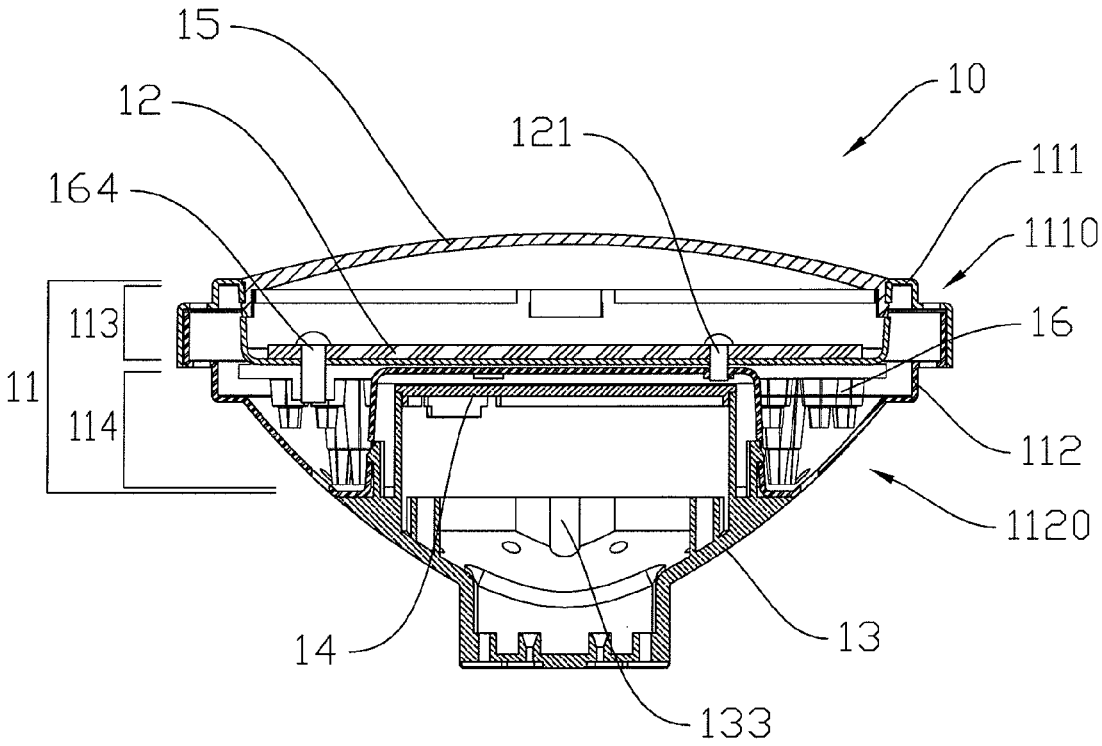
FIG. 4E shows a cross-sectional view of the assembled heat dissipating member of the LED bulb according to the first embodiment of the present invention.
Figure 5A:
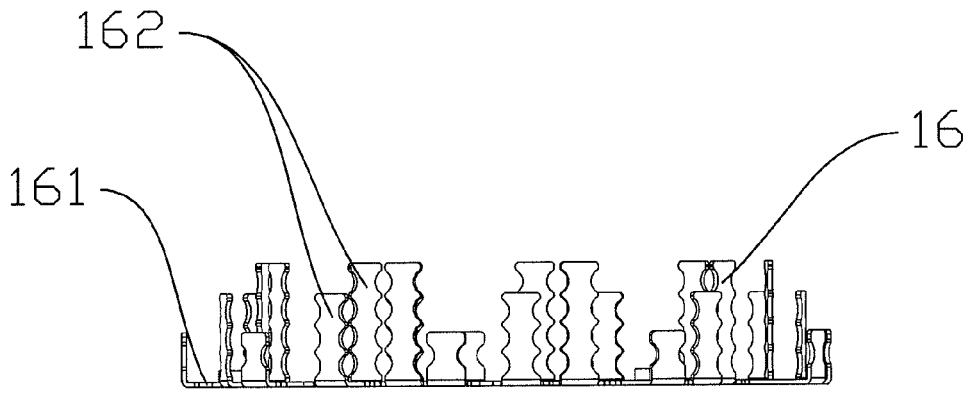
FIG. 5A shows a side view of the heat dissipating member of the LED bulb according to the second embodiment of the present invention.
Figure 5B:
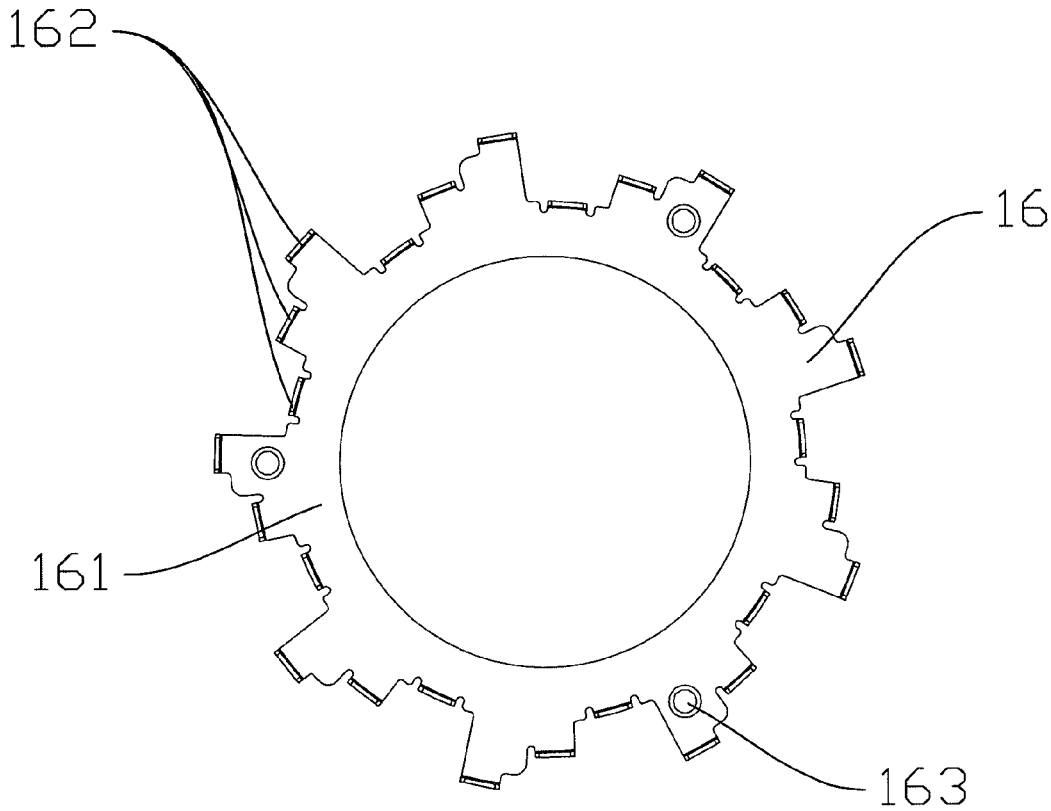
FIG. 5B shows a top view of the heat dissipating member of the LED bulb according to the second embodiment of the present invention.
Figure 5C:
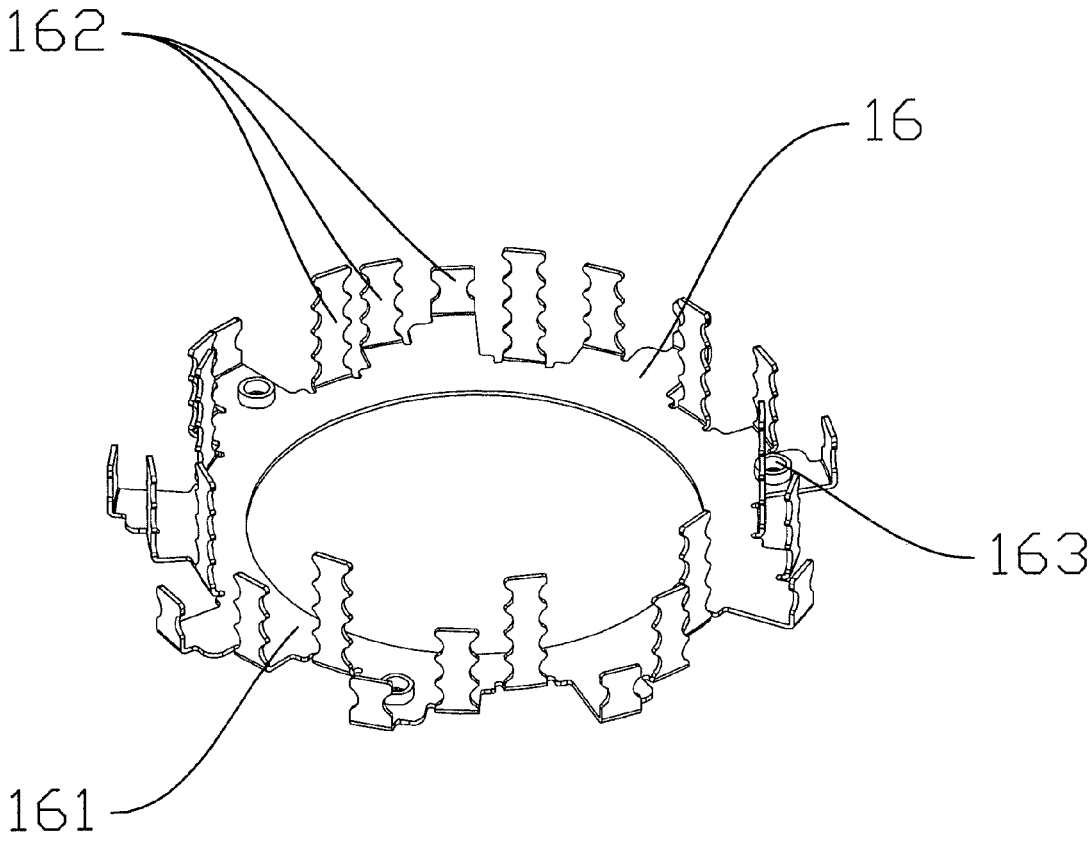
FIG. 5C shows a three-dimensional view of the heat dissipating member of the LED bulb according to the second embodiment of the present invention.
Figure 5D:
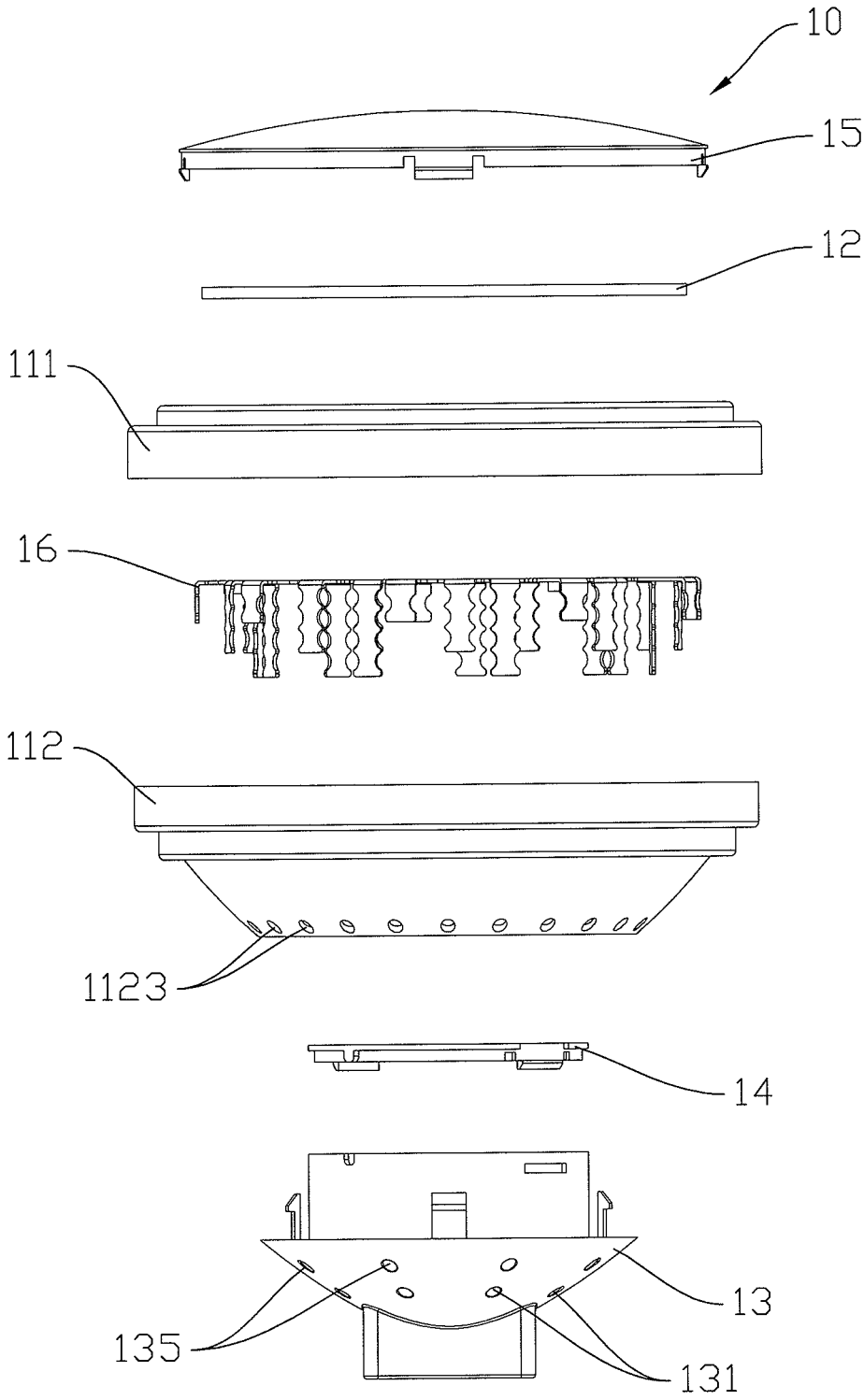
FIG. 5D shows an exploded view for assembling the heat dissipating member of the LED bulb according to the second embodiment of the present invention.
Figure 5E:
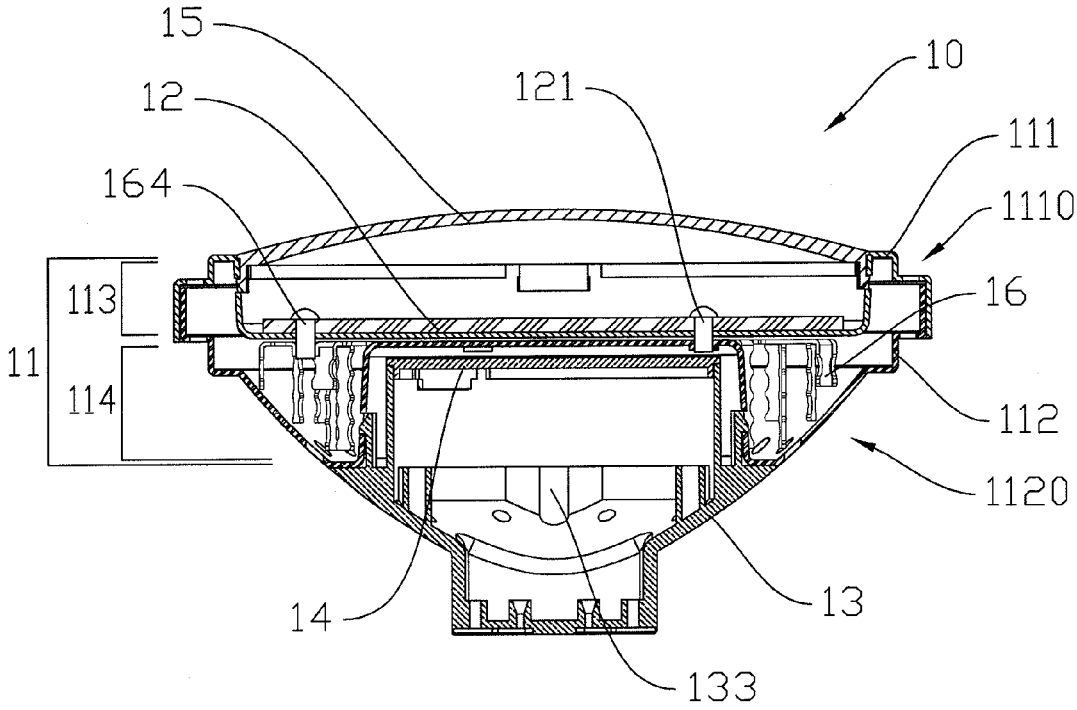
FIG. 5E shows a cross-sectional view of the assembled heat dissipating member of the LED bulb according to the second embodiment of the present invention.

FIG. 3 shows a schematic diagram of applying a flat lampshade to the LED bulb according to the present invention. As shown in the figure, instead of the curved lampshade, the schematic diagram shows that the lampshade 15 can be replace by the flat one. The shape of the lampshade 15 can also be adjusted according to the realistic requirements in lighting or decoration; it is not limited to these two shapes. In addition, the various shapes of the lampshade 15 can be applied to any of the embodiments described above.

FIGS. 4A, 4B, 4C, 4D, and 4E show side, top, three-dimensional, exploded, and cross-sectional views of the heat dissipating member of the LED bulb according to the first embodiment of the present invention. As shown in the figure, the present invention has a heat dissipating member 16, which includes a substrate 161 and a plurality of heat sink members 162. The plurality of heat sink members 162 are disposed on the same side of the substrate 161. According to the present embodiment, the plurality of heat sink members 162 are hexagonal pillars, and are suitable for flat bulbs. The height and number of circles of the plurality of heat sink members 162 are determined by the outer diameter of the lamp cup 11 as well as by the size of the second accommodating space 114. The number of circles can be one or multiple. Thereby, the shapes, structures, and numbers of the substrate 161 and the plurality of heat sink members 162 can be changed according to the environment. The present embodiment is only an example, not used for limiting the heat dissipating member 16. While overall assembling, the heat dissipating member 16 is stacked between the first and second hollow cylinders 1110, 1120. The substrate 161 of the heat dissipating member 16 is attached tightly to the bottom of the first hollow cylinder 1110. The various junctions of the substrate 12, the light receiving part 111, and the heat dissipating member 16 are attached by thermally conductive paste of glue, respectively. Then a copper screw 164 is used for fastening all three. By means of the thermally conductive paste and the copper screw 164, the heat generated by the substrate 12 can be conducted downwards rapidly to the heat dissipating member 16, and then dissipated through the housing of the lamp cup 11 and the plurality of heat dissipating holes 1121, 1123. Accordingly, the heat dissipating efficiency of the substrate 12 can be enhanced.

FIGS. 5A, 5B, 5C, 5D, and 5E show side, top, three-dimensional, exploded, and cross-sectional views of the heat dissipating member 16 of the LED bulb according to the second embodiment of the present invention. The plurality of heat sink members 162 according to the present embodiment are sawtooth-shaped thin plates applicable to long straight bulbs. The length of the plurality of heat dissipating members 162 can be adjusted according to the structure of the bulb, and is not limited to the length according to the embodiment.

Figure 6:
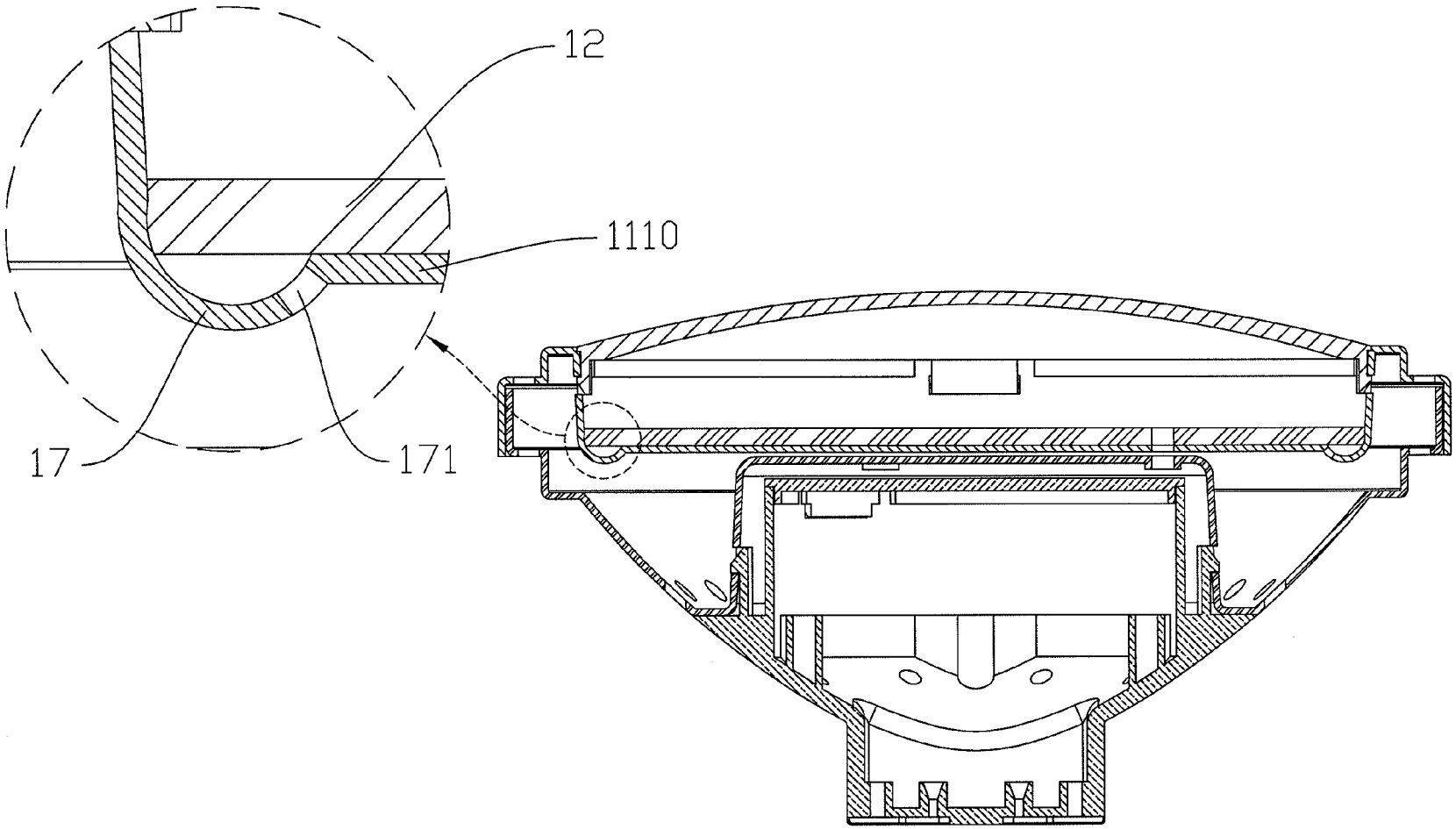
FIG. 6 shows a schematic diagram of the heat dissipating space of the LED bulb according to the present invention.
Figure 6A:
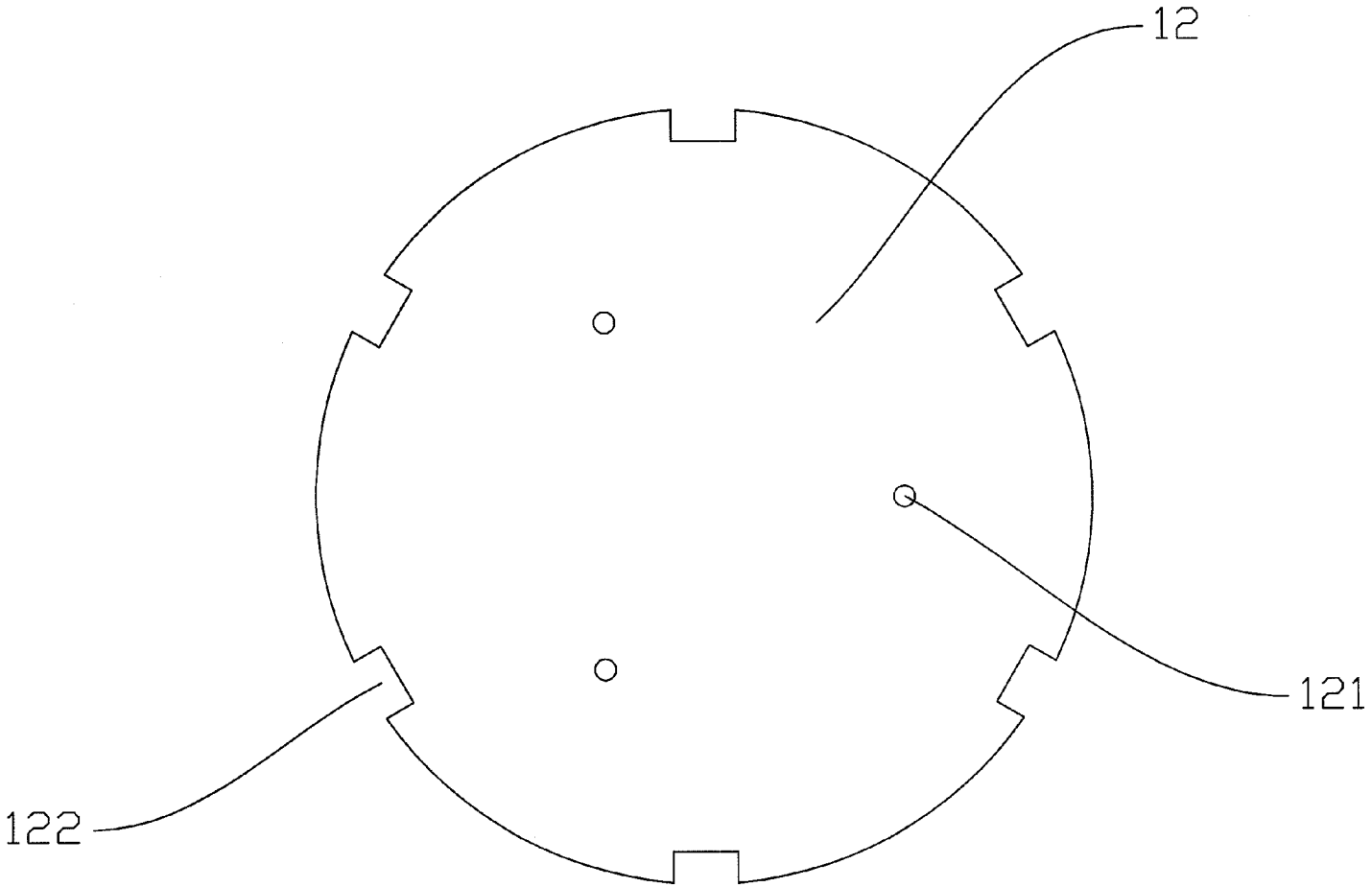
FIG. 6A shows a top view of the substrate of the LED bulb according to the present invention.

FIG. 6 FIG. 6A show a schematic diagram of the heat dissipating space and a top view of the substrate of the LED bulb according to the present invention. As shown in the figures, the first accommodating space 113 has an annular recessed part 17, which has a plurality of eighth heat dissipating holes 171. The curvature of the annular recessed part 17 is adopted for matching the proper interior radius of the lamp cup 11. The substrate 12 is attached closely to the sidewall while being placed in the first accommodating space 113. Besides, because the substrate 12 has a plurality of notches 122, a small gap will be maintained between the plurality of notches 122 and the first accommodating space 113. For LEDs with high light emitting efficiency, in order to dissipate the generated great amount of heat, the present structure of heat dissipating space is purposely designed. The structure of heat dissipating space solves the problems of heat exhaustion and light leakage through gaps after the substrate and the lamp cup are assembled. Furthermore, after long-term hermetically sealing, the generated high-temperature heat will deteriorate the light emitting efficiency of the LEDs. The present structure can also improve this problem. Due to the tight attachment of the substrate 12 to the sidewall, the heat and the hot air generated by the substrate 12 can be guided sideways and downwards, and then dissipated through the plurality of eighth heat dissipating holes 171 of the annular recessed part 17. Because of gap of the structure of heat dissipating space is relatively small, light loss is avoided, and thus enhancing the light emitting efficiency.

Figure 7A:
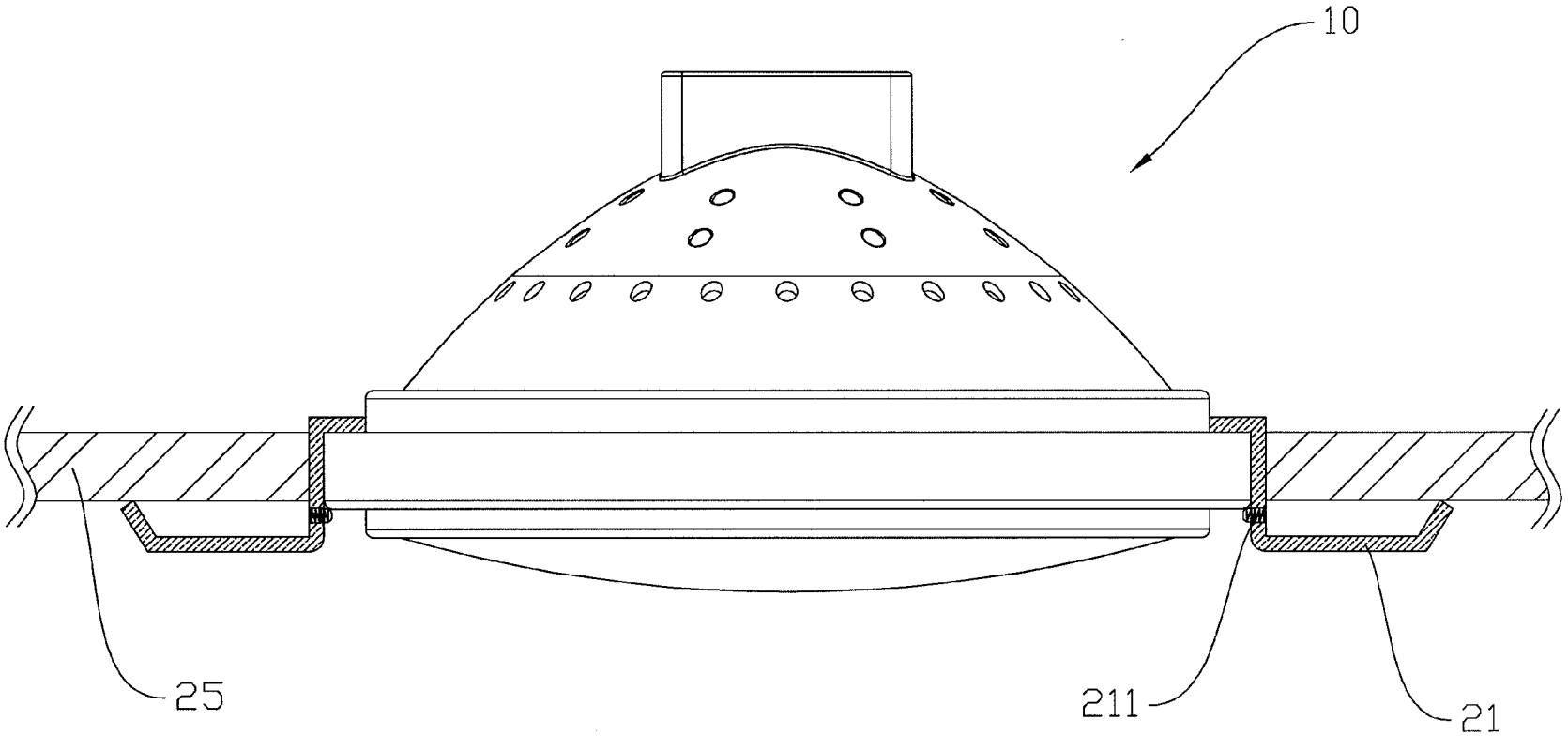
FIG. 7A shows a schematic diagram of the LED bulb according to the present invention installed on the downlight frame.
Figure 7B:
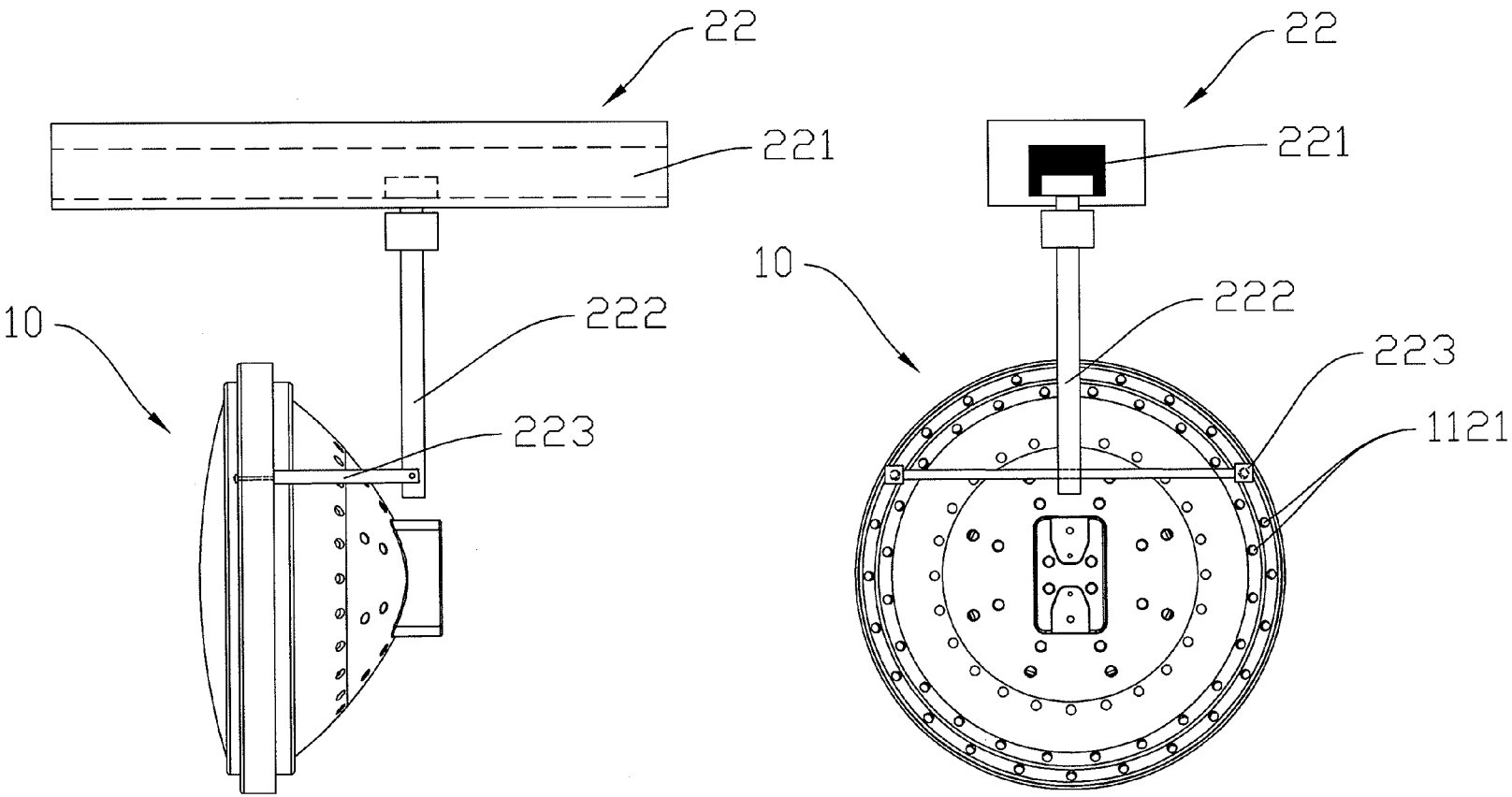
FIG. 7B shows a schematic diagram of the LED bulb according to the present invention installed on the rail frame.
Figure 7C:
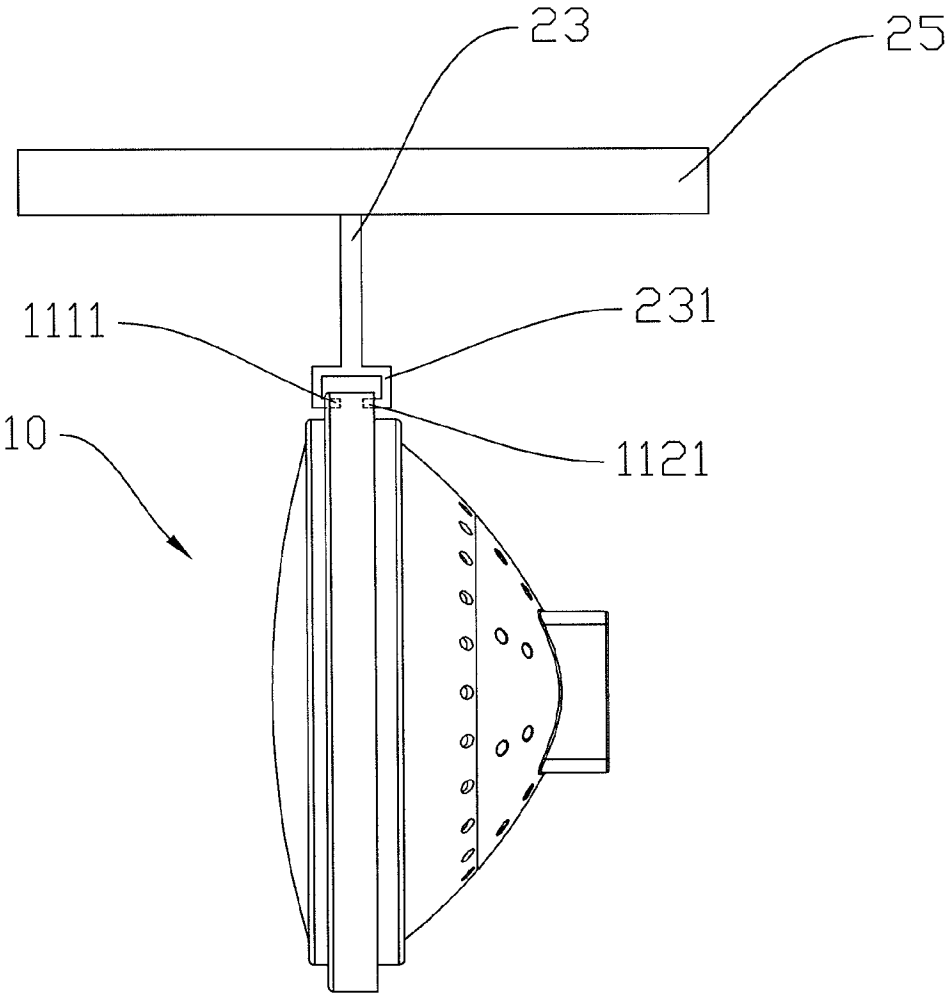
FIG. 7C shows a schematic diagram of the LED bulb according to the present invention installed on the clipping frame.
Figure 7D:
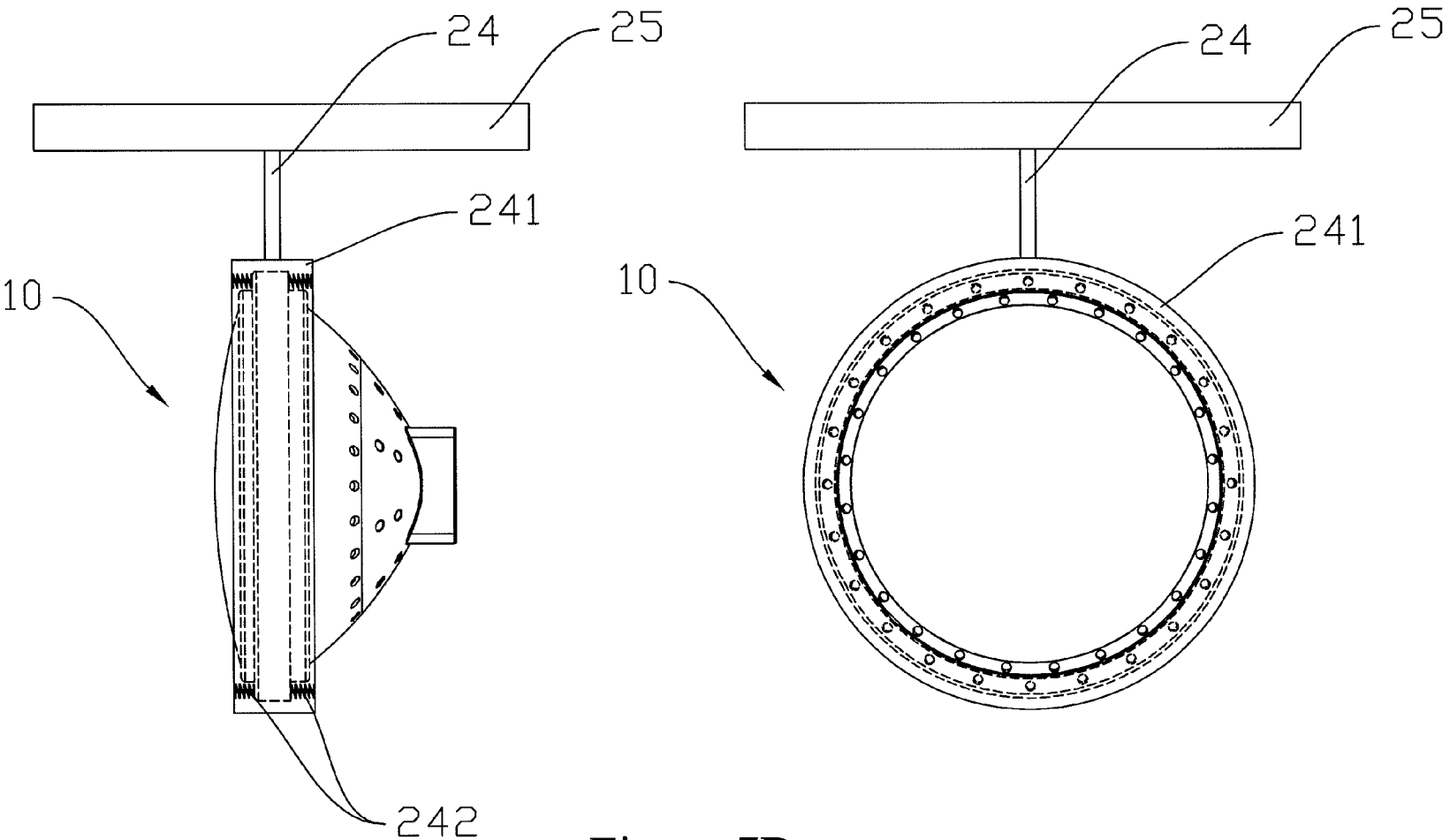
FIG. 7D shows a schematic diagram of the LED bulb according to the present invention installed on the hollow circular frame.

In addition to the inherent heat dissipating function of the plurality of first and second heat dissipating holes 1111, 1121 of the LED bulb 10 according to the present invention, various clipping and holding tools and be provided for fixing. By accompanying the structure of the lamp cup 11, the bulb 10 according to the present invention can be disposed in various frames. FIGS. 7A, 7B, 7C, and 7D show schematic diagrams of the LED bulb according to the present invention installed on the downlight frame, rail frame, clipping frame, and hollow circular frame. As shown in FIG. 7A, when the bulb 10 is installed to a downlight frame 21, the lamp cup 11 is wedged therein. Then a plurality of spring buckles 211 of the downlight frame 21 fix the bulb 10 at the front end. As shown in FIG. 7B, the bulb 10 is installed to a rail frame 22, which includes a movable shaft and a fixed shaft 223. While installing, the fixed shaft 223 and the appropriate paired first and second heat dissipating holes 1111, 1121 are assembled first. Then the movable shaft 222 is installed in a rail 221. As shown in FIG. 7C, the bulb 10 is installed in a clipping frame 23. An end of the clipping frame 23 is fixed on a solid plane such as the ceiling. A clipping part 231 at the other end clips the bulb 10. The clipping part 231 clips the bulb 10 by means of a first heat dissipating hole 1111 and a second heat dissipating hole facing each other only. As shown in FIG. 7D, the bulb 10 is installed in a hollow circular frame 24, which includes a hollow circle 241. The hollow circle 241 has a plurality of clipping springs 242 therein. An end of the hollow circular frame 24 is fixed on a solid plane such as a ceiling 25. After the bulb 10 is installed in the hollow circle 241, the plurality of clipping springs 242 fix the bulb 10 from the front and rear ends. The above four methods for installing the bulb are only examples, not for limiting the scope of the present invention. Once the size matches or applicable to the plurality of first and second heat dissipating holes 1111, 1121, the bulb 10 according to the present invention can be fixed with ease. Accordingly, by means of the structure of the bulb 10 as well as the plurality of first and second heat dissipating holes 1111, 1121, many methods can be adopted for fixing, which makes selection of bulbs more flexible and not limited to specific forms.

To sum up, the present invention provides an LED bulb, which comprises a lamp cup, a substrate, a power connecting part, and a cover plate. The lamp cup is a two-piece structure. The power connecting part further has a power driver therein. Because the substrate is disposed inside the lamp cup and the power connecting part is connected with the lamp cup, when the light sources and the power driver generate heat, the generated heat can be pass on for heat dissipation via the lamp cup or the power connecting part. Because the heat generated by the two heat sources in the lamp cup, the co-heating effect of the light sources and the power driver can be avoided. Because the overall structure is manufactured in materials with superior thermal conductivity, the heat dissipating process can be accelerated, which enhances substantially the light emitting efficiency as well as the lifetime of the light sources. If the power of the light sources is large, better heat dissipating efficiency is required. By accompanying the corresponding heat dissipating member and the specially designed heat dissipating space, heat can be guided downwards rapidly and thus improving the heat dissipating efficiency. IN addition, the outmost circle of heat dissipating holes can use as clipping holes. By using the structure of the lamp cup, the bulb can be fixed with ease. There are many methods for installation, making the usage of the bulb more flexible and without limitation.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A light emitting diode bulb, comprising:

a lamp cup, including a light receiving part and a lamp-cup part, said light receiving part substantially being a first hollow cylinder, said first hollow cylinder having a first accommodating space above, a substrate disposed in said first accommodating space, said lamp-cup part having a second hollow cylinder, said second hollow cylinder having a second accommodating space at the recessed bottom, said first hollow cylinder contacted with said second hollow cylinder; and a power connecting part, having a third hollow cylinder, said third hollow cylinder having a power driver therein, and disposed in said second accommodating space;

wherein said light receiving part further includes a first annular body and a second annular body disposed at the upper end and the peripheral side of said first hollow cylinder and extending outwards in sequence, respectively; said lamp-cup part further includes a first annular groove and a second annular groove disposed at upper end of said second hollow cylinder and extending from bottom up in sequence, said second annular body is wedged in said second annular groove for assembling said part and said lamp cup part.

2. The light emitting diode bulb of claim 1, and further comprising a lampshade disposed on said first accommodating space of said lamp cup part.

3. The light emitting diode bulb of claim 2, wherein said lampshade is a curved or flat lampshade.

4. The light emitting diode bulb of claim 1, wherein a plurality of third heat dissipating holes are disposed at the bottom part of said lamp-cup part.

5. The light emitting diode bulb of claim 4, wherein a cover plate is disposed on said third hollow cylinder.

6. The light emitting diode bulb of claim 1, wherein the diameter of said first annular body is smaller than the diameter of said second annular body.

7. The light emitting diode bulb of claim 1, wherein a plurality of first heat dissipating holes are disposed on said first annular body and said second annular body.

8. The light emitting diode bulb of claim 1, wherein the diameter of said first annular groove is smaller than the diameter of said second annular groove.

9. The light emitting diode bulb of claim 1, wherein a plurality of second heat dissipating holes are disposed on said first annular groove and said second annular groove.

10. The light emitting diode bulb of claim 1, wherein said power connecting part and said lamp-cup part are connected by wedging or scarfing.

11. A light emitting diode bulb, comprising:

a lamp cup, including a light receiving part and a lamp-cup part, said light receiving part having a first hollow cylinder, said first hollow cylinder having a first accommodating space above, said lamp-cup part having a second hollow cylinder, said second hollow cylinder have a second accommodating space at the recessed bottom, said first hollow cylinder stacked on said second hollow cylinder, further including a substrate disposed in said first accommodating space of said lamp-cup part, and further including a heat dissipating member stacked between said first hollow cylinder and said second accommodating space; and a power connecting part, having a third hollow cylinder, said third hollow cylinder having a power driver therein, and disposed in said second accommodating space;

wherein said light receiving part further includes a first annular body and a second annular body disposed at the upper end and the peripheral side of said first hollow cylinder and extending outwards in sequence, respectively; said lamp-cup part further includes a first annular groove and a second annular groove disposed at upper end of said second hollow cylinder and extending from bottom up in sequence, said second annular body is wedged in said second annular groove for assembling said light receiving part and said lamp cup part; and a plurality of first heat dissipating holes are disposed on said first annular body and said second annular body.

12. The light emitting diode bulb of claim 11, wherein said heat dissipating member includes a substrate and a plurality of heat sink members disposed on the same side of said substrate.

13. The light emitting diode bulb of claim 12, wherein said plurality of heat sink members are three-dimensional pillars.

14. The light emitting diode bulb of claim 12, wherein said plurality of heat sink members are sawtooth-shaped thin plates.

15. A light emitting diode bulb, comprising:

a lamp cup, including a light receiving part, and said light receiving part having an annular recessed part on the bottom edge, said light receiving part having a first hollow cylinder, said lamp-cup part having a second hollow cylinder;

a substrate, disposed at the bottom of said light receiving part; and a power connecting part, having a power driver therein, and said power connecting part disposed below said lamp cup;

wherein said light receiving part further includes a first annular body and a second annular body disposed at the upper end and the peripheral side of said first hollow cylinder and extending outwards in sequence, respectively; said lamp-cup part further includes a first annular groove and a second annular groove disposed at upper end of said second hollow cylinder and extending from bottom up in sequence, said second annular body is wedged in said second annular groove for assembling said light receiving part and said lamp cup part; a plurality of second heat dissipating holes are disposed on said first annular groove and said second annular groove.

16. The light emitting diode bulb of claim 15, wherein said annular recessed part has a plurality of eighth heat dissipating holes.

17. A light emitting diode bulb, comprising:

a lamp cup, including a light receiving part and a lamp-cup part, said light receiving part having a first hollow cylinder, said first hollow cylinder having a first accommodating space above, said lamp-cup part having a second hollow cylinder, said second hollow cylinder have a second accommodating space at the recessed bottom, said first hollow cylinder stacked on said second hollow cylinder, said light receiving part further including a first annular body and a second annular body disposed at the upper end and the peripheral side of said first hollow cylinder and extending outwards in sequence, respectively; said first annular body and second annular body having a plurality of first heat dissipating holes, said lamp-cup part further including a first annular groove and a second annular groove disposed at upper end of said second hollow cylinder and extending from bottom up in sequence, said first annular groove and second annular groove having a plurality of second heat dissipating holes; and further including a substrate disposed between said first accommodating space of said lamp-cup part; and a power connecting part, having a third hollow cylinder, said third hollow cylinder having a power driver therein, and disposed in said second accommodating space.

18. The light emitting diode bulb of claim 17, and further comprising a downlight frame, including a plurality of spring buckles, disposed on a ceiling, and said bulb disposed in said downlight frame by said plurality of spring buckles.

19. The light emitting diode bulb of claim 17, and further comprising a rail frame, including a movable shaft and a plurality of fixed shafts, an end of said movable shaft passing through a rail, and an end of said plurality of fixed shafts fixed in said first heat dissipating holes and said second heat dissipating holes of said bulb.

20. The light emitting diode bulb of claim 17, and further comprising a clipping frame, including clipping part, disposed on a ceiling, and clipping a first heat dissipating hole and a second heat dissipating hole of said bulb.

21. The light emitting diode bulb of claim 17, and further comprising a hollow circular frame, including a hollow circle and a plurality of clipping springs, disposed on a ceiling, and said bulb disposed in said hollow circle by said plurality of clipping springs.

* * * * *